US008556742B2

(12) United States Patent
John

(10) Patent No.: US 8,556,742 B2
(45) **Date of Patent: *Oct. 15, 2013**

(54) GOLF CLUB HEAD WITH VISUAL SWING INDICATOR

(75) Inventor: T. Stites John, Weatherford, TX (US)

(73) Assignee: NIKE, Inc., Beaverton, OR (US)

( * ) Notice: Subject to any disclaimer, the term of this patent is extended or adjusted under 35 U.S.C. 154(b) by 396 days.

This patent is subject to a terminal disclaimer.

(21) Appl. No.: 12/900,317

(22) Filed: Oct. 7, 2010

(65) Prior Publication Data

US 2011/0081982 A1 Apr. 7, 2011

Related U.S. Application Data

(63) Continuation-in-part of application No. 12/464,649, filed on May 12, 2009, now Pat. No. 7,828,669.

(51) Int. Cl.
*A63B 69/36* (2006.01)
*A63B 53/04* (2006.01)

(52) U.S. Cl.
USPC ..... 473/219; 473/231; 473/238; 473/242; 473/252; 473/327

(58) Field of Classification Search
USPC ..... 473/219–256, 324–350; D21/742–746, D21/733, 755, 759, 751
See application file for complete search history.

(56) References Cited

U.S. PATENT DOCUMENTS

| | | | | |
|---|---|---|---|---|
| D58,209 | S | 6/1921 | Bachellor | |
| 1,485,272 | A | 2/1924 | Harold | |
| 1,546,612 | A | 7/1925 | Barnes | |
| 1,660,126 | A | 2/1928 | Heeter | |
| D89,332 | S | 2/1933 | Bartsch | |
| 2,620,186 | A * | 12/1952 | Beeaff, Jr. | 473/231 |
| 2,781,197 | A * | 2/1957 | Wiley | 473/249 |
| 2,842,369 | A | 7/1958 | East | |
| 2,859,972 | A | 11/1958 | Reach | |
| 2,908,504 | A | 10/1959 | William | |
| 2,934,347 | A | 4/1960 | Siniscalchi | |
| 3,680,860 | A | 8/1972 | Elkins, Jr. | |

(Continued)

FOREIGN PATENT DOCUMENTS

| | | |
|---|---|---|
| JP | Sho 55-47874 | 3/1980 |
| JP | Hei 4-111367 | 9/1992 |
| JP | 2006-21025 | 1/2006 |

OTHER PUBLICATIONS

Final Office Action issued on Apr. 26, 2011 in related U.S. Appl. No. 12/869,982.

(Continued)

*Primary Examiner* — Sebastiano Passaniti
(74) *Attorney, Agent, or Firm* — Banner & Witcoff, Ltd.

(57) ABSTRACT

A golf club head with a body and an asymmetrical visual swing indicator is provided. The asymmetrical visual swing indicator may be formed to represent an apparent backswing path outward of an actual backswing path. In certain configurations the asymmetrical visual swing indicator is positioned such that a portion of the asymmetrical visual swing indicator closest to the hitting surface of the golf club is closer to a heel end plane of the golf club head then a portion of the asymmetrical visual swing indicator closest to a rear surface of the golf club head. The swing indicator is integral with the body of the golf club head.

19 Claims, 21 Drawing Sheets

(56) References Cited

U.S. PATENT DOCUMENTS

| | | | | | |
|---|---|---|---|---|---|
| 3,921,984 | A | * | 11/1975 | Winter | 473/251 |
| 3,979,125 | A | | 9/1976 | Lancelotti | |
| 3,997,170 | A | | 12/1976 | Goldberg | |
| D245,437 | S | | 8/1977 | Thiel | |
| 4,139,196 | A | | 2/1979 | Riley | |
| 4,157,830 | A | | 6/1979 | Taylor et al. | |
| 4,174,839 | A | | 11/1979 | Marrs | |
| 4,214,754 | A | | 7/1980 | Zebelean | |
| 4,291,883 | A | | 9/1981 | Smart et al. | |
| D268,357 | S | * | 3/1983 | Mader | D21/733 |
| 4,659,083 | A | * | 4/1987 | Szczepanski | 473/252 |
| 4,819,943 | A | | 4/1989 | Szczepanski | |
| 4,828,265 | A | | 5/1989 | Antonious | |
| 4,930,783 | A | | 6/1990 | Antonious | |
| 5,193,810 | A | | 3/1993 | Antonious | |
| 5,417,429 | A | * | 5/1995 | Strand | 473/251 |
| 5,452,897 | A | | 9/1995 | Mick | |
| 5,676,603 | A | | 10/1997 | Miller | |
| 5,720,668 | A | | 2/1998 | Brett | |
| 5,839,970 | A | | 11/1998 | Lombardo | |
| 5,984,800 | A | * | 11/1999 | Uebelhor | 473/251 |
| 6,059,669 | A | | 5/2000 | Pearce | |
| 6,146,287 | A | | 11/2000 | Rugge et al. | |
| 6,379,258 | B1 | | 4/2002 | To | |
| 6,558,268 | B2 | * | 5/2003 | Tindale | 473/244 |
| 6,988,955 | B2 | | 1/2006 | Stoakes | |
| D516,147 | S | | 2/2006 | Imamoto | |
| 7,077,757 | B1 | | 7/2006 | Payne et al. | |
| 7,147,570 | B2 | | 12/2006 | Toulon et al. | |
| 7,371,184 | B2 | | 5/2008 | Tao | |
| 7,407,443 | B2 | * | 8/2008 | Franklin et al. | 473/251 |
| D577,405 | S | * | 9/2008 | Oldknow et al. | D21/759 |
| 7,758,439 | B2 | | 7/2010 | Roenick | |
| 7,828,669 | B1 | * | 11/2010 | Stites | 473/219 |
| 7,905,792 | B1 | | 3/2011 | Stites et al. | |
| 8,235,830 | B2 | * | 8/2012 | Stites | 473/219 |
| 8,348,780 | B2 | * | 1/2013 | Stites | 473/231 |
| 2003/0148821 | A1 | | 8/2003 | Morgan et al. | |
| 2004/0204257 | A1 | | 10/2004 | Boscha et al. | |
| 2004/0219987 | A1 | | 11/2004 | Scott et al. | |
| 2005/0075185 | A1 | * | 4/2005 | Green | 473/240 |
| 2005/0187028 | A1 | | 8/2005 | Chang et al. | |
| 2005/0192114 | A1 | | 9/2005 | Zider et al. | |
| 2006/0014590 | A1 | | 1/2006 | Tao | |
| 2006/0166757 | A1 | | 7/2006 | Butler et al. | |
| 2006/0223646 | A1 | * | 10/2006 | Rife | 473/251 |
| 2006/0293112 | A1 | | 12/2006 | Yi | |
| 2007/0004525 | A1 | | 1/2007 | Lee et al. | |
| 2007/0072693 | A1 | | 3/2007 | Kallberg | |
| 2007/0217661 | A1 | | 9/2007 | Massoud | |
| 2007/0254745 | A1 | | 11/2007 | Graves | |
| 2008/0015045 | A1 | | 1/2008 | Payne et al. | |
| 2008/0287210 | A1 | | 11/2008 | Womersley | |
| 2009/0017933 | A1 | | 1/2009 | Stites et al. | |
| 2009/0054172 | A1 | | 2/2009 | Meehan | |

OTHER PUBLICATIONS

International Search Report and Written Opinion from PCT/US2010/033978, dated Aug. 19, 2010.

Office Action from related matter for U.S. Appl. No. 12/869,982, mailed Nov. 2, 2010.

International Search Report and Written Opinion issued Jan. 4, 2012 in PCT Application No. PCT/US2011/054682.

Notice of Reasons for Rejection, issued Jul. 24, 2013, in corresponding Japanese Patent Application No. 2012-510870.

* cited by examiner

GOLF CLUB HEAD WITH VISUAL SWING INDICATOR

RELATED APPLICATIONS

This application is a continuation-in-part application of U.S. patent application Ser. No. 12/464,649, filed May 12, 2009, which is hereby incorporated by reference in its entirety.

FIELD OF THE INVENTION

The present invention relates to a golf club, more particularly, to a golf club head with a visual swing indicator.

BACKGROUND

The swing of a golfer including the backswing and the downswing of a golfer is often related to the golfer's performance on the golf course. Golfers that can consistently swing a golf club in preferred manners may hit the golf ball farther, straighter and in a more consistent manner. Accuracy, control and direction may be improved when a golfer's swing has certain attributes associated with preferred swing directions and motion paths. However, many golfers have difficulty swinging golf clubs according to certain preferred swing directions and motion paths. Also, because only portions of a full swing of a golf club are visible to the golfer, it may be more difficult to correct an improper backswing or downswing swing path. While certain golf club swing aids of the prior art provide a number of advantageous features, they nevertheless have certain limitations. The present invention seeks to overcome certain of these limitations and other drawbacks of the prior art, and to provide new features not heretofore available.

SUMMARY

Inventive aspects pertain to a golf club head with an asymmetrical visual swing indicator on a top surface of the body of the golf club head and configured to represent an apparent backswing path. The apparent backswing path may be distinct and outward of an actual backswing path of the golf club head during a swing of a golfer. The golf club head includes a hitting surface on the front surface. The golf club head may also be coupled to a shaft.

Additionally, inventive aspects also relate to a triangularly shaped asymmetrical visual swing indicator oriented on a top surface of a golf club head. The triangularly shaped asymmetrical visual swing indicator may include a shortest side that is parallel with a hitting surface. On an opposing end the asymmetrical visual swing indicator may end in a pointed end at the toe end of the rear side of the top surface.

In another inventive aspect, a golf club head has an asymmetrical visual swing indicator on the top surface extending from a hitting surface housed on a front surface of the body to a rear surface of the body opposite the hitting surface. The asymmetrical visual swing indicator is positioned such that a portion of the asymmetrical visual swing indicator closest to the hitting surface is closer to a heel end of the golf club head than a portion of the asymmetrical visual swing indicator closest to a rear surface of the golf club head. The golf club head may be coupled to a shaft.

According to yet additional examples of the invention, a visual swing indicator may be integrally formed with the golf club head such that the perimeter shape of the golf club head is altered. The integrally formed visual swing indicator may also exhibit three dimensional characteristics to facilitate visual referencing by a golfer and to further enhance a visible impression created by the visual indicator.

DESCRIPTION OF THE DRAWINGS

The foregoing Summary of the Invention, as well as the following Detailed Description of the Invention, will be better understood when read in conjunction with the accompanying drawings.

DETAILED DESCRIPTION

Figure 1A:
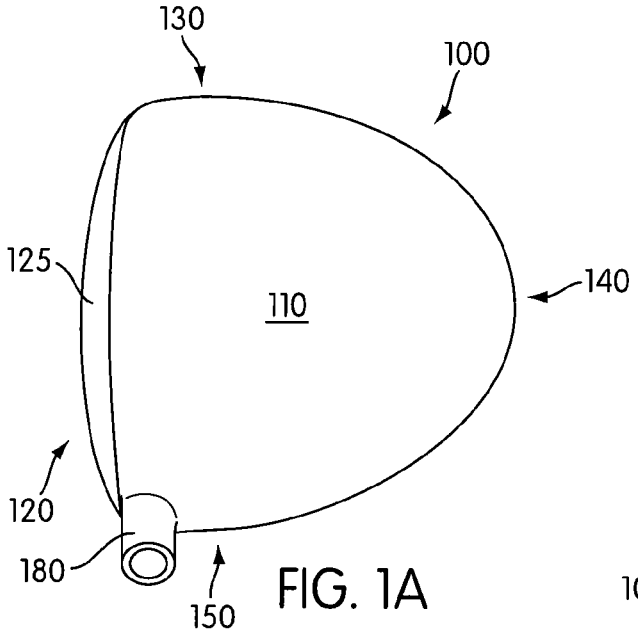
FIGS. 1A-1D are illustrative top plan, toe end, heel end and front views respectively of a golf club head.
Figure 1B:
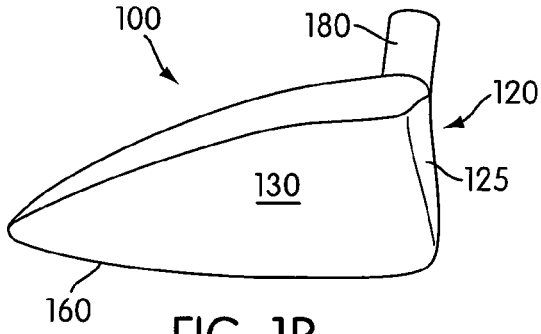
Figure 1C:
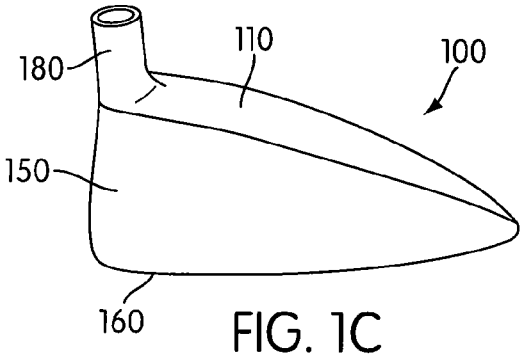
Figure 1D:
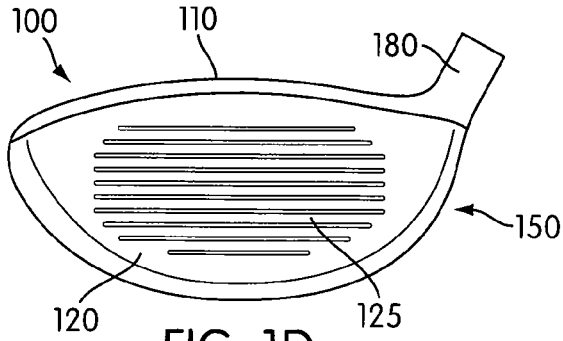

In the following description of the various embodiments, reference is made to the accompanying drawings that depict illustrative arrangements in which the invention may be practiced. It is understood that other embodiments may be utilized and modifications may be made without departing from the scope of the present invention. Additionally, various terms used herein are defined below.

FIGS. 1A-1D are schematic top, toe end, heel end and front views, respectively, of an illustrative golf club head 100. As is apparent from the figures, a golf club head may illustratively be considered to include a top 110, a front 120, a toe end 130, a rear 140, a heel end 150 and a bottom (or sole) 160. Further, a golf club head 100 typically includes a hosel 180 formed to, among other things, facilitate connection of the golf club head 100 to the shaft 190. Hosel(s) 180 and shaft(s) 190 are well known in the art. Hosels 180 are commonly formed with the remainder of the golf club head 100 as a single body member.

Front surface 120 typically houses a hitting surface 125 configured for striking a golf ball. Hitting surface 125 may include any of a variety of features, configurations, shapes, surfaces and details. For example, hitting surface 125 may include a series of horizontal grooves that facilitate desired flight of the golf ball when the hitting surface 125 impacts a golf ball. Spacing, size, depth, shape, contour and orientation of these grooves may vary based on club type (and/or particular club manufacturer) to achieve a desired ball flight characteristic. Also, hitting surface 125 may be formed of a hardened material or may be treated to strengthen or harden the material in anticipation of the hitting surface repeatedly being used to impact the golf ball. Many other forms of surface treatments and ornamentation may be incorporated into the hitting surface 125, from hardened materials to holes, grooves, and corrugation and various other hitting surface materials, structures and configurations that are well known. The illustrative golf club head 100 illustratively shown in FIGS. 1A-1D may be commonly referred to as a "wood-type" golf club head. Wood-type golf heads may include drivers, fairway woods, hybrids clubs and other golf club heads. However, other golf club heads including "iron-type" golf club heads, putters and any other golf club heads are contemplated with regard to FIGS. 1A-1D and the corresponding illustratively features described above.

Figure 2:
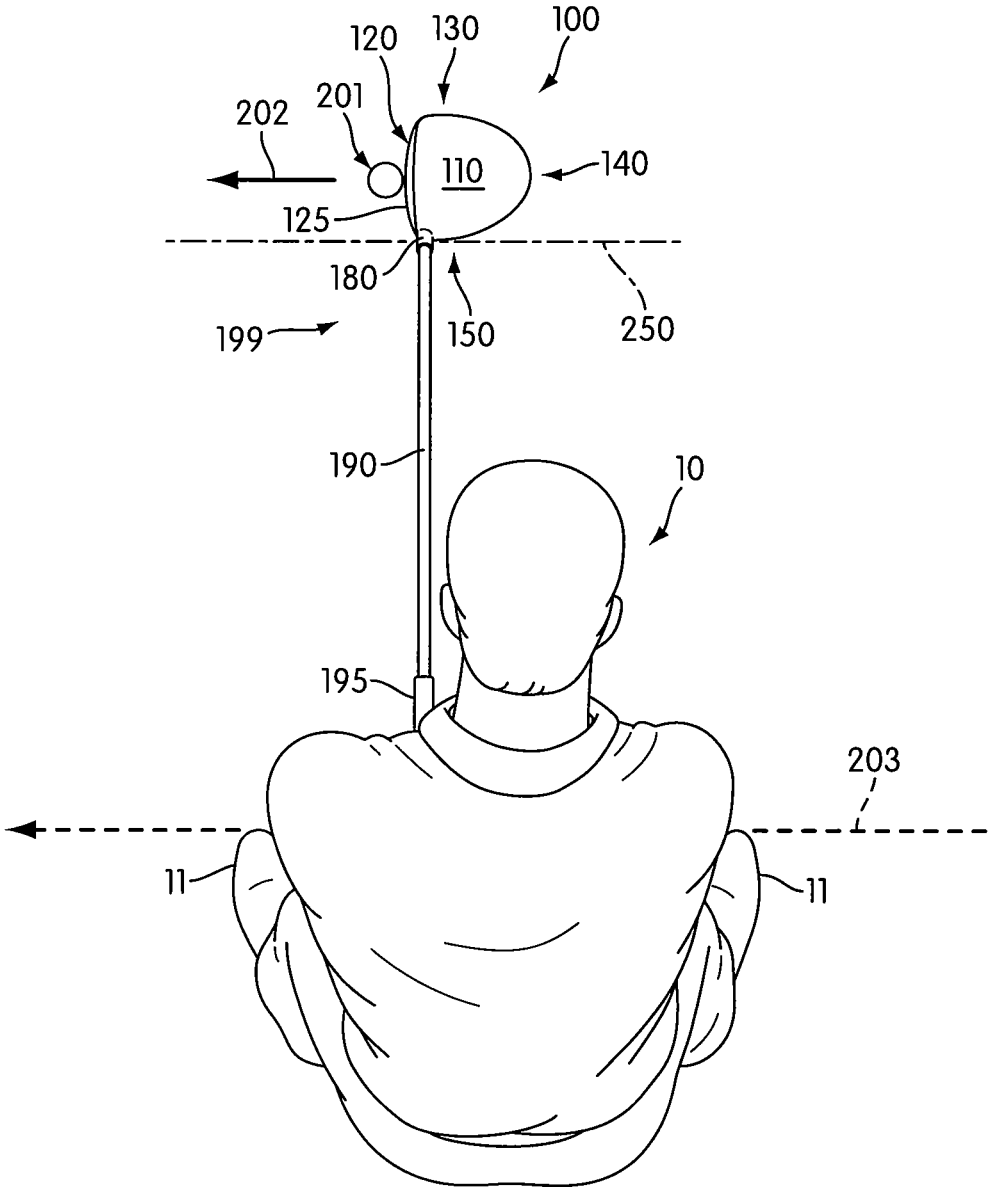
FIG. 2 is an illustrative top plan view of a golfer addressing a golf ball with a golf club including a golf club head coupled to a shaft.

FIG. 2 is an illustrative top plan view of a golfer 10 addressing a golf ball 201 with a golf club head 100. The addressing state shown in FIG. 2 is generally considered a start position for a golfer's swing for hitting a golf ball 201. The golf club 199 typically includes a shaft 190 coupled to the head 100 at the hosel 180. A grip 195, by which a golfer 10 holds or grips the golf club 199, is attached to the shaft 190 at the end opposite the head 100. Grips 195 are known and may vary significantly depending on preferences, ergonomic characteristics, and tendencies of the golfer, such as a tendency to hit a slice or a fade. For example, grips vary in "grip size" and in circumference. They also vary in particular texture and grip pattern on the outer surface of the grip. Grips can be round or may have a line or rib on the underside to assist the golfer in placement of his hands. Other shapes are also contemplated. Grips may be composed of a number of materials including rubbers, polymers, and leather, to name a few. The grip traits may be varied by, for example, by making the grip corded or selecting any of various materials based upon the frictional properties of that material.

Shaft 190, as is also known in the art, may be varied in length, material composition, stiffness, flex and other traits and features. For example, golfers may select shafts formed of a variety of materials in light of characteristics of those materials. For example, flex and stiffness are among the illustrative characteristics that may be contemplated when selecting a particular shaft or shaft material as a preferred shaft stiffness may vary from golfer to golfer depending on skill, strength and swing characteristics including swing speed or swing path. In at least one categorization system, shafts may be categorized as Extra Stiff, Stiff, Regular, Senior and Ladies depending on the particular flex characteristics. Like other golf club features, the shaft 190 and grip 195 will often be selected based upon golfer "feel" as well as traits relating to the golfers physical make-up and swing characteristics and tendencies.

As is apparent in FIG. 2, golfers generally position their feet 11 in an orientation generally aligned in the direction in which the golfer desires or is aiming to hit the golf ball 201. Although, depending on golfer preference and particular type of club being used (driver versus 5-iron versus wedge), foot positioning may be varied from this illustrative positioning as is known in the art so as to be askew by a certain rotation from the general desired travel path. For illustrative purposes in FIG. 2, arrow 202 demonstrates a "general" desired travel path of the ball 201 after the golfer 10 strikes the golf ball 201 with the front 120 (the face) of the golf club 199. The golfer's feet alignment, as demonstrated by the arrow 203, illustratively depicts the golfer's stance as being generally parallel with the general desired travel path of the ball 202. As is known, an actual travel path 202 of the ball 201 may vary from the general desired travel path as a golfer may either hit a "fade" or a "slice" of varying degrees. Likewise, the ball's flight may vary in its initial direction and general flight path curve, however, it may be desired that the ball be curved back to finish in general alignment with the general desired travel path of the ball 202. Additionally, for reference purposes, broken line 250 illustrates a heel end plane running along the heel end 150 of the golf club head and perpendicular to the ground (assuming the ground is flat). As is apparent when the golfer 10 is in a typical addressing state as shown in FIG. 2, the heel end plane 250 is parallel to the general desired travel path 202 and the golfer's feet alignment 203.

Figure 3A:
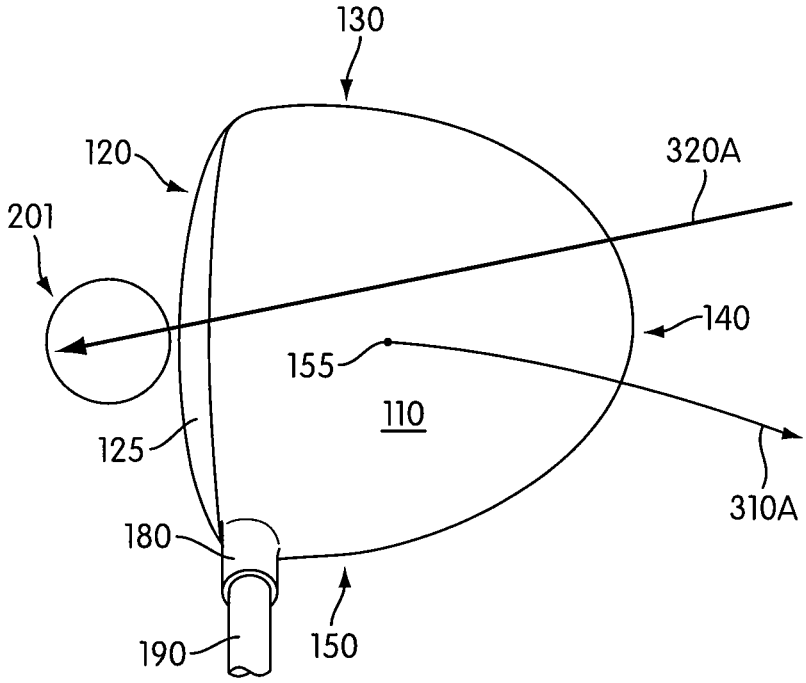
FIGS. 3A and 3B are illustrative top plan views of a golf club head and various illustrative swing paths.
Figure 3B:
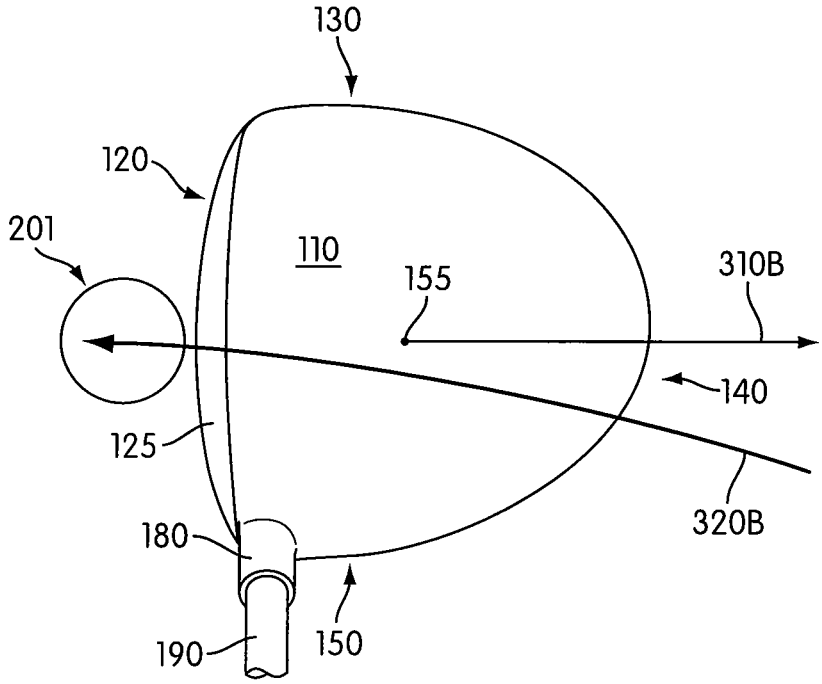

FIGS. 3A and 3B are illustrative top plan views of golf club heads and various exemplary swing paths including illustrative backswings and downswings. A golf swing may generally be considered as having an addressing state followed by backswing in which the club head 110 via the shaft 190 and hosel 180 is generally pulled rearward (and upward) of the golf ball 201 to be hit. During this backswing, the golfer also typically rotates his torso and "shifts his weight" using his legs. In essence, a golfer during the backswing is twisting or coiling his body and/or providing space in anticipation of the downswing motion that will contact the golf ball 201. The golfer 10 may continue his backswing as is known in the art until the golfer 10 reaches a "top" of the swing and then begins a downswing along a downswing path.

A center 155 of golf club head 100 is used as a reference point for further clarity and comparison in demonstrating various swing paths and directions in the figures. FIG. 3A is an illustrative diagram of a golf club head 100 depicting the swing tendencies of a high handicap player (e.g. a player that has a higher number as their "handicap" according to the well known handicapping system of rating golfers based upon their play and scores.) Generally speaking, as shown in FIG. 3A, a high handicap golf player can have a tendency to "take-away" the golf club head 100 with a more inward (heel end 150) path than recommended by golf pros and conventional swing mechanics. For example, a high handicap golfer may have a tendency to take-away the golf club head 100 from its position shown in the addressing state along the initial backswing path 310A as is depicted in FIG. 3A. In this instance, the take-away or initial backswing path 310A has a generally inward or heelward path. When a golfer 10 begins his/her backswing along backswing path 310A along this inward or heelward trajectory, he will continue that backswing path until it reaches the top of his/her backswing as is known in the art.

The specific position known as the top of the backswing can vary from golfer to golfer but it is generally know to be at a position when the shaft 190 reaches a parallel position with the ground. Of course, for varying degrees of partial swings rather than full swings this position may be significantly short of this parallel shaft position. Additionally, some golfers, including professional golfers may have a backswing that extends beyond this parallel position when they are attempting to generate significant power and trying to, for example, hit the ball at the maximum distance for a certain club.

A golfer that has an initial backswing path 310A begins the club head with a more inward or heelward path than traditionally desired and will often continue his swing with an overly inward or heelward trajectory. In order to continue this inward backswing trajectory, the golfer's 10 arms are forced inward and are prevented from remaining generally extended as desired according to preferred swing mechanics. The golfer will then reach the top of his swing in a position varied from an optimal top position (for example, arms further inward and cramped and torso rotation not completed).

After reaching the top of the backswing, the golfer will now begin a downswing until the golf club head 100 contacts the golf ball 201 and then the golfer 10 will finish his swing with the "follow-through." Here, because the golfer will reach the top of the backswing in misaligned position, the golfer will have a tendency to overcompensate, as the golfer uncoils and rotates back towards the initial addressing state for contacting the golf ball 201. For example, the golfer will feel cramped and his arms will be and feel too close too his body to return to an extended position at the time of contact as he moves through the downswing. The golfer may also have trouble returning to an aligned position sufficiently quickly during the downswing so the golfer will feel hurried to "catch-up" during the swing so as to not leave the club face of the golf club open. As a result of the initial backswing path 310A being inward or heelward of a preferred path the downswing path of the golfer 10 will be affected.

As illustrated in FIG. 3A, the golfer will perform a downswing that begins outward of a preferred position. This misalignment will be carried through as the golfer will strike the ball 201 with the hitting surface 125 on the front surface 120 of the golf club head 100 with an askew outward to inward direction through the hitting area as is demonstrated in FIG. 3A. As shown, the golf club head 100 will travel with an ending downswing travel path 320A. Additionally, the front face 120 of golf club head 100 may have a rotated orientation compared to its orientation in the corresponding state of FIG. 2. Accordingly, an incorrect or contrary to convention/preference path of motion and orientation of the golf club head 100 will cause the golf ball 201 to be contacted by the hitting surface 125 of golf club head 100 contrary to a desired orientation and contact direction. Further, this varied ending downswing path 320A will cause the flight path of golf ball 201 to vary from a general desired flight path 202 and after it is contacted by the hitting surface 125 and kinetic energy from the golf club head 100 is transferred to the ball 201. The varied resulting ball 201 flight may embody a number of undesirable variations on a desired or optimal ball flight. Distance may be lost. The ball may have a flight path of a slice or fade when a generally straight ball flight is desired. Even if the flight path of the golf ball 201 after being hit by a swing as described in FIG. 3A is generally straight it may be askew directionally due to the path of club head movement 310A at time of contact being diagonal relative to a desired flight path 202. Additionally, a club head front 120 including hitting surface 125 may be rotated relative to a desired "square" or other orientations leading to additional spin or direction variances to be introduced into the resulting ball flight.

FIG. 3B is an illustrative diagram of a golf club head 100 depicting the swing of a preferred backswing and downswing path of a golfer to achieve preferred results. While each golfer may have a somewhat unique and particular swing, golfers of low handicap including professional golfers typically have swing tendencies that are similar or correlate to the described and depicted in FIG. 3B. As is depicted, contrary to the swing tendencies of a high handicap golfer, low handicap golfers have an initial backswing path 310B that is generally straight rearward from the addressing state. By having an initial take-back that is generally straight, the golfer typically continues his/her backswing along a preferred backswing path until reaching a "top" of the backswing. The low handicap golfer draws the golf club head 100 generally rearward and upward and typically rotates his torso and "shifts his weight" using his legs during a backswing. As described, the low handicap golfer is twisting or coiling his body and/or providing space in anticipation of the downswing motion that will contact the golf ball. However, contrary to that shown in FIG. 3A, the backswing including initial backswing path 310B are proper as the initial take-away of golf club head 100 is straight forward. Accordingly, there is an increased likelihood and tendency for the golfer 10 with an initial backswing path 310B to reach the top of his swing in a proper position and orientation, such that when the golfer then proceeds with the downswing he will be likely to return to the square or slight inward to outward preferred swing path, specifically, ending downswing path 320B.

It is apparent that the preferred ending downswing path 320B is distinct from the initial backswing path 310B and not merely the same path in the reverse direction. This variation is well known in the art as based upon dynamics and mechanics of the golf swing as the golfer is connected to the golf club head 100 through the shaft 190 and grip 195. Accordingly, in a preferred mechanics golf swing, the golf club is generally pivoted around the hands of the golfer as the golfer swings. However, as mentioned and is known in the art, the golfer's lower body including his legs and torso also move, translate, and/or rotate to allow the golfer to generate a smooth and powerful swing. Because the golf club head 100 is coupled to the golfer 10 and his hands gripping the grip 195 through shaft 190 and grip 195 during the swing, the golf club head 100 will be moved from a somewhat inward position during the downswing and become aligned with the golf ball 201 in the general desired travel path 202 (which is often parallel with the alignment of the golfer's feet) when the hitting surface 125 of the golf club head 100 impacts golf ball 201 or only a little bit before hand. As a result of the hitting surface 125 of the golf club head 100 impacting the golf ball 201 in a square position the golf ball will likely have a ball flight or travel path similar in direction to the desired travel path 202.

From the depiction and accompanying descriptions of FIGS. 3A and 3B it is apparent how the initial backswing path 310A-B will likely affect the downswing and performance of the golfer 10 and the associated particular swing as a whole including the striking of the ball 201. As shown in FIG. 3A, a golfer 10 that takes the golf club head 100 back inside, e.g. initial backswing path 310A, will typically cast over and return the club head in an "outside-inside" manner as illustrated in FIG. 3A. As a result, the golfer hits the ball on the toe end 130 of the hitting surface 125 ("toeing") and/or slices the ball. In contrast, as illustrated in FIG. 3B, a golfer 10 that takes the golf club head 100 straight rearward or square during the take-away such that the initial backswing path 310B is straight, has a greater likelihood of returning the golf club head 100 in an inside out downswing path including resulting in generally square contact between the golf ball 201 and the hitting surface 125 at the "sweet spot." While a golfer 10 may recognize that a straight take-away of the club is desirable, high handicap golfers, golfers that play infrequently and other golfers may develop habits, tendencies or improper muscle-memory movements such that further assistance is needed to help prevent such golfers from continually repeating these common mistakes especially relating to the backswing or initial take-away of golfers.

For example, golfers often refer to a "feel" when contact is made between the club and the ball and also during just the backswing and downswing among other times during a round of golf. As such, certain golfers through repetition of improper swing mechanics may have trained their body such that when the golfer 10 moves the golf club head 100 in a preferred initial backswing path 310B, this take-away feels wrong and the golfer does not feel as if they are taking the golf club head 100 rearward 140 in the desired manner. Likewise, when the golfer 10 moves the golf club 199 such that the golf club head 100 has an initial backswing path 310A the golfer 10 may feel as if their backswing was proper and straight when in fact their backswing was incorrect and not straight rearward. Therefore, a mechanism for making a golfer 10 with tendencies to perform a backswing along initial backswing path 310A perform an initial backswing path 310B in accordance with preferred mechanics of golf is beneficial.

Figure 4:
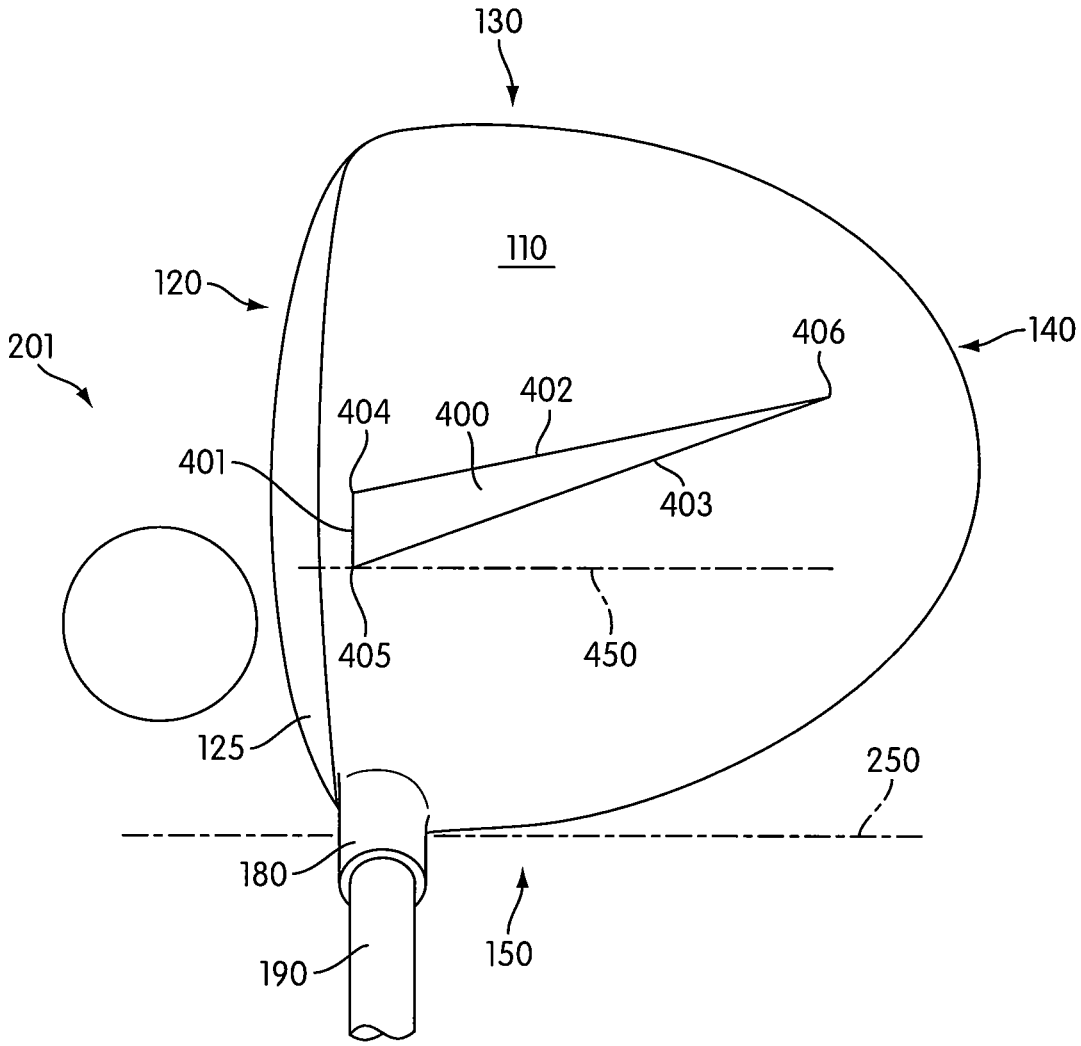
FIG. 4 is an enlarged illustrative top plan view of a golf club with a visual swing indicator.

FIG. 4 depicts an illustrative diagram of a visual swing indicator 400 housed on the top surface 110 configured to assist the golfer taking the golf club head 100 back "straight" or "square." To facilitate a proper initial backswing path 310B despite a golfer's improper tendencies a visual swing indicator 400 may be housed on a top surface 110 of a golf club head 100 to help the golfer 10 take the golf club head 100 back more square. A visual swing indicator 400 may have a variety of particular configurations including varied size, shapes, dimensions, orientations and appearances, etc. Depending on particular tendencies of a golfer, the visual swing indicator 400 may have a particular configuration. For example, to assist a golfer 10 with an initial backswing path 310A due to a tendency to bring the golf club head 100 inward during the backswing rather than straight back, the visual swing indicator 400 is orientated such that the front side of the visual swing indicator 400 is parallel to the front surface 120 of the golf club head 100 and the visual swing indicator 400 runs rearward and towards the toe end 130. In such a configuration the visual swing indicator 400 may be described as pointing from a front of a golf club head 100 toward an area between the rear 140 and the toe end 130 of the golf club head 100. A golfer 10 in an addressing state looking downward at the top surface 110 of the golf club head 100 will view the visual swing indicator 400 as a reminder and a pointer as to the direction that the golfer should begin the take-away of the golf club head 100 from the addressing state. Thus, when the golfer 10 begins the take-away of the golf club head 100 he will "feel" as if he is bring the golf club head outward of a straight initial backswing path 310B. However, in fact, he will be performing an initial backswing path 310B that has a straight rearward path. Accordingly, by following the visual swing indicator 400 indicated path which acted as reminder and guide as to which direction to take-away the golf club head 100 from the initial addressing state, a golfer can more easily overcome a tendency to have an improper take-away such as the initial backswing path 310A of FIG. 3A. Because golfer 10 now was able to modify his backswing to have an initial backswing path 310B that is generally straight rearward, there is an increased likelihood the golfer 10 will be able to return the golf club head 100 in a proper path through the hitting region and contact the golf ball 201 in a proper and preferred fashion including an ending downswing path 320B rather than ending downswing path 320B, as was previously described.

In the depicted illustrative configuration shown in FIG. 4, the asymmetrical swing indicator 400 is triangularly shaped with first, second and third sides 401, 402, 403 and first, second and third corners 404, 405, and 406. For reference purposes, any one of the sides 401-403 and/or one of the corners 404-406 may be considered an "end" of the visual swing indicator 400. Additionally, as is apparent from FIG. 4, the visual swing indicator 400 in this configuration is oriented such that the overall shape of visual swing indicator 400 points in the rear 140 and toe end 130 direction from the perspective of a golfer 10 in an addressing state. First side 401 of the visual swing indicator 400 is the shortest side in length. Second side 402 is second in length and third side 403 is the longest side. As such, each of the three sides 401, 402, 403 has a different length.

The visual swing indicator 400 in certain configurations may be positioned such that the first side 401 sits closer to the heel end 150 of the golf club head and is parallel to the hitting surface 125 on the front surface 120 of the golf club head 100. As described, the other two sides 402, 403 of the visual swing indicator 400 will then run such that the asymmetrically shaped visual swing indicator 400 has an orientation running from the front 120 and the heel end 150 of the top surface 110 to the toe 130 and rear end 140. Accordingly, side 402 of the visual swing indicator 400 may be aligned with a portion of the ball 201 closest to the toe end 130 when the golfer 10 is in the addressing state. In this alignment, the golf ball will sit on the heel end 150 side of a center of the golf club head 100. While golfers traditionally try and align a golf ball to be in the center of the golf club head 100 and in particular in the center region of the hitting surface 125 (which is commonly referred to as the sweet spot), this configuration of the visual swing indicator 400 will encourage a golf ball 201 to be aligned closer to a heel end 150, than a toe end 130. Positioning the golf ball 201 in this fashion in the addressing state also facilitates and assists the golfer 10 in an improved swing and performance as most golfers (including high handicap golfers) have a tendency to strike the golf ball 201 with the hitting surface 125 during the downswing portion of the swing at a location approximately a half inch or even more closer to the toe end 130 of the hitting surface 125 than where they lined up when they were in the addressing state. Therefore, positioning the golf ball 201 a given distance closer to the heel end 150 of the hitting surface 125 in the addressing position may facilitate the golfer striking the golf ball with the center or "sweet spot" of the hitting surface of the golf club head by accounting for the described tendency to strike the ball further on the toe end 130 of the club head 100 than the alignment location in the initial addressing state. By aligning the toe end side 402 of the visual swing indicator 400 with a toe end side of the golf ball 201, a smooth visual impression can be formed that facilitates proper swing mechanics despite tendencies of the golfer 10. Additionally, initial alignment of the golf ball may be more easily and more consistently accomplished because the visual swing indicator 400 may also be used as a reference for aligning and positioning the golf club head 100 in the addressing state. While the golf ball 201 may be aligned with the visual swing indicator 400 in the fashion described during the addressing position, the visual swing indicator 400 may also be formed such that first side 401 is centered between the toe end 130 and heel end 150 and aligned with the center of the hitting surface 125. Certain golfers may strike the golf ball 201 at the same position on the hitting surface 125 and thus a centered alignment in the addressing state may better facilitate proper alignment and striking of the golf ball during the golfer's downswing. Likewise, the visual swing indicator 400 in certain configurations may even be positioned such that a front side 401 sits closer to the toe end 130 than the heel end 150. Accordingly, it is understood by those with skill in the art that the particulars of the visual swing indicator 400 especially including positioning on the top surface 110 of the golf club head 100 may be varied depending on the swing tendencies, physical characteristics and preferences of an individual golfer 10.

Figure 5A:
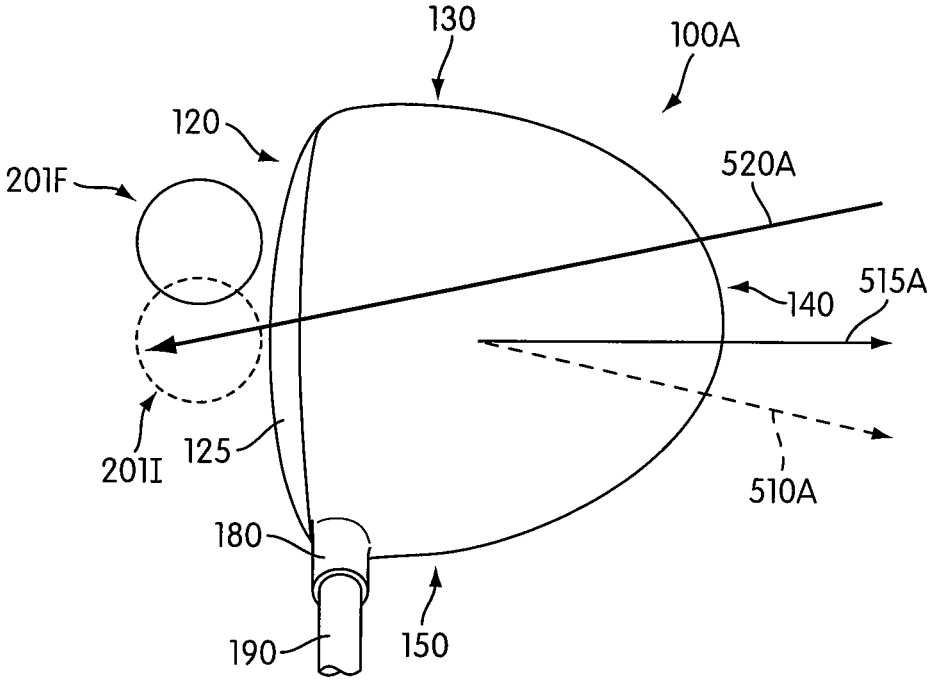
FIGS. 5A-5B are illustrative top plan views of various golf club heads depicting swing paths and tendencies.
Figure 5B:
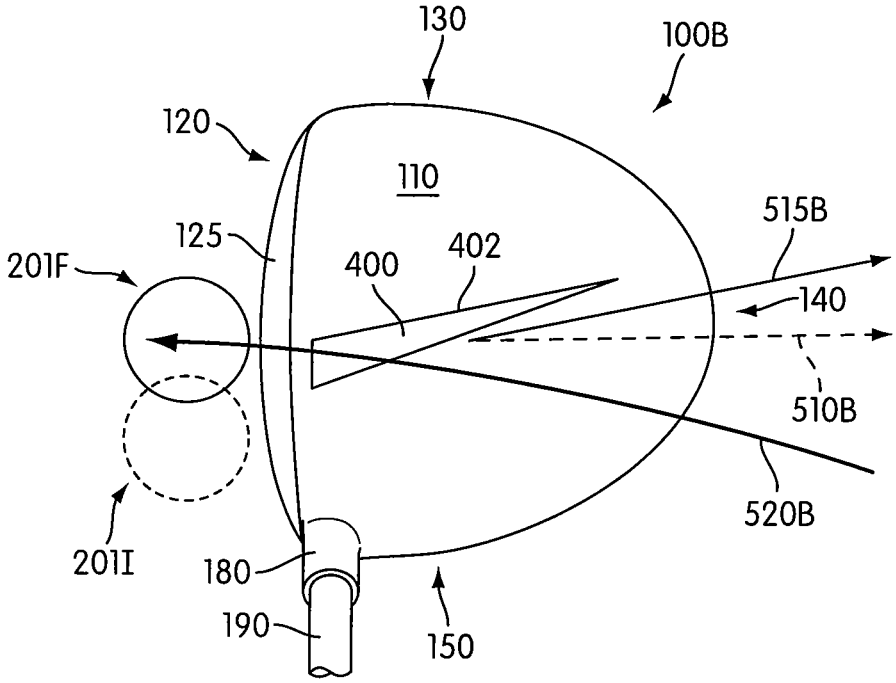

FIGS. 5A-B, in accordance with that described with respect to FIGS. 3A-4, illustrative one configuration of a golf club head 100 with a visual swing indicator 400 housed on the top surface assisting a golfer in performing a golf swing according to traditional preferred golf swing mechanics. FIG.

5A illustrates the feel of a backswing and a downswing of a golfer using a traditional golf club head. In an addressing state as shown, the golfer will align the golf club head 100 with the golf ball 201I (shown in broken lines). Here the golf ball 201I may typically be on the ground or on a tee and centered between the toe end 130 and the heel end 150 as shown. The golfer 10 then begins his backswing. FIG. 5A illustrates that the golfer with tendencies to bring the golf club head 100 inward will believe he is taking the golf club head 100 back along a backswing path 515A when the golfer is in fact taking the golf club head 100 back along actual backswing path 510A. As described, this initial inward take-away of the golf club head 100 will make it more likely that the golfer will not return the club head 100 in a square manner along a traditionally preferred golf downswing and instead will come from an outward in direction as illustrated by downswing path 520A. Additionally (and often relatedly), the golfer will also contact the golf ball in a position closer to the toe end than where the golf ball 201 was positioned relative to the golf club head 100 in the addressing state.

In contrast, various golfers, especially including golfers with high handicaps, can overcome swing tendencies and perform a swing more consistent with the recognized preferred swing mechanics and paths of golf professionals. As illustrated in FIG. 5B, the golf club head 100 houses an asymmetrical visual swing indicator 400. In the addressing state, the golf club head 100 may be positioned such that the second side 402 of the visual swing indicator 400 is aligned with a toe end of the golf ball 2011. A golfer in the addressing state will look down at the top 110 of club head 100 and using the visual swing indicator 400 he will bring back the golf club head along an actual backswing path 510B which is straight back despite an apparent backswing path 515B based upon the visual impression that the visual indicator 400 provides during the initial take-away. Now, the golfer 10 will continue his backswing, reach the top, and then will perform his downswing. As discussed, the golfer, having taken the golf club head back square along actual backswing path 510B is significantly more likely to return the golf club head 100 through a hitting region and through an ending downswing path 520B such that a proper swing path is performed so the ball 201 is contacted in the sweet spot at the central region of the hitting surface and with the golf club head 100 including hitting surface 125 in a proper square orientation. As described, the golfer 10 is able to rely on the visual swing indicator 400 to guide him in his initial backswing or take-away despite the fact the swing may not "feel" like the club is being taken back square. Thus, because the apparent backswing path 515B (formed by visual swing indicator 400) is outward of the actual backswing path 510B, a golfer with a tendency to have an initial backswing inward of a square take-away may rely on the visual swing indicator 400 to perform the backswing in a preferred manner. Thus a resulting preferred downswing and contact with the golf ball 201 is accomplished. The resulting shot is thus likely to exhibit improved distance, control, direction and other characteristics as a result of the improved swing mechanics and paths of the golfer's swing.

It is understood and contemplated that each golfer varies in physical characteristics and swing tendencies. While certain visual swing indicators 400 and golf clubs utilizing visual swing indicators 400 may be appropriate for a range of golfers, a variety of visual swing indicator 400 configurations are contemplated consistent with the principles described herein. Similarly, while configurations involving wood-type golf clubs have been used, a variety of configurations involving a variety of club types have been contemplated.

Figure 6A:
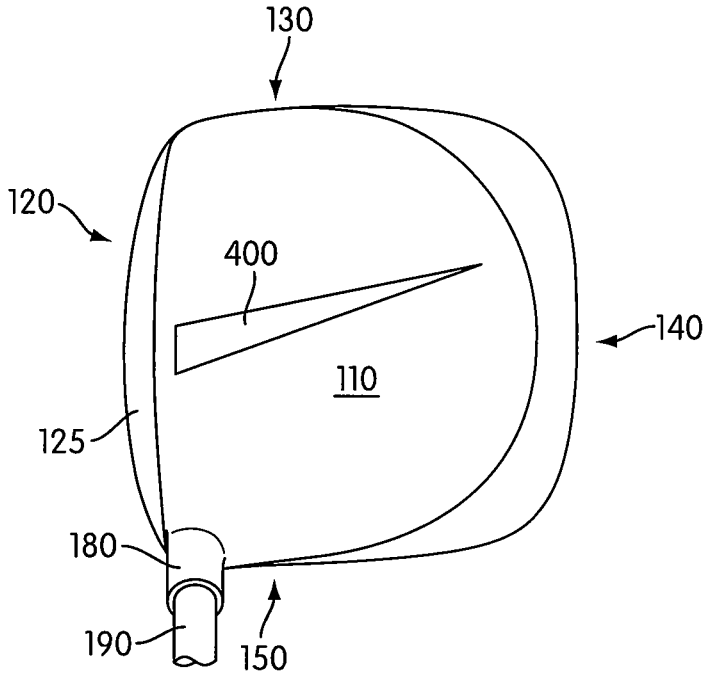
FIGS. 6A-6C are illustrative top plan views of golf club heads with visual swing indicators.
Figure 6B:
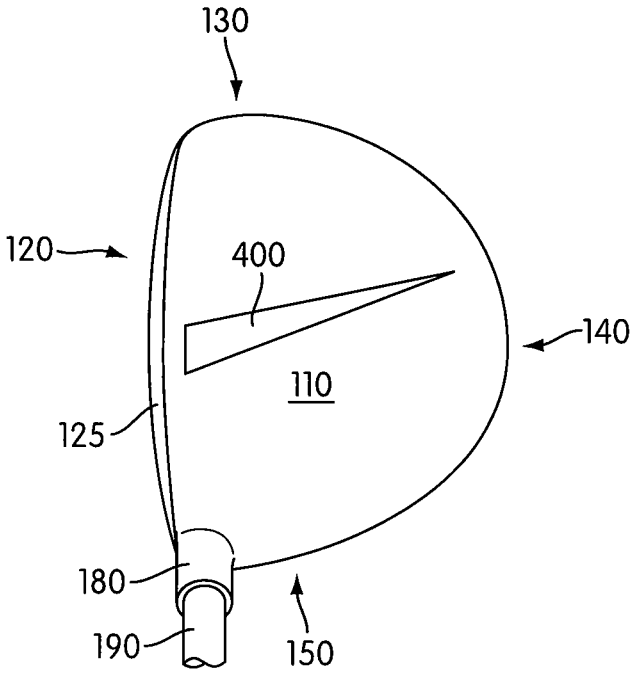
Figure 6C:
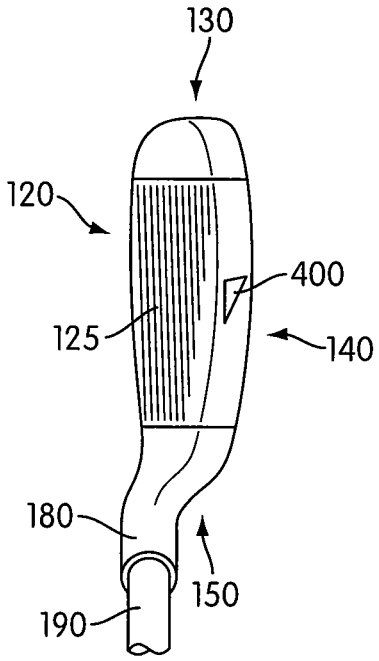

FIGS. 6A-6C illustratively depict several configurations of golf club heads 100 housing visual swing indicators 400 consistent with the principles described. While the previous figures have illustratively shown a rounded wood type golf club head, configurations utilizing the visual swing indicator 400 with square club heads including square and oversized drivers are contemplated. Additionally, configurations of hybrid golf club heads with a visual swing indicator 400 are also contemplated. Further, while iron-type golf club head, such as the golf club head 100 shown in FIG. 6C, conventionally have a smaller top surface 110 than a wood-type golf club head, especially in a front 120 to rear 140 direction, configurations of irons utilizing the described principles are also contemplated. As shown in FIG. 6A-6C, the specific dimensioning and shape of the visual swing indicator 400 may be varied for an associated club head 100 or for the tendencies of the golfer such that the desired visual swing assistance functions are accomplished. For example, a smaller visual swing indicator 400 is housed on a top surface 110 of the golf club head 100 in FIG. 6C. Here, the asymmetrical visual swing indicator 400 is also triangularly shaped but the dimensions and appearance of the triangularly shaped visual swing indicator 400 are distinct from those shown in FIGS. 6A and 6B. Variations in the particular shape and orientation may be made to correlate to an individual golfer's swing tendencies but also to variations in typical swing tendencies that may vary by club type as a typical swing of a golfer using an iron-type golf club is typically distinct from the same golfer's swing with a wood-type golf club. Thus, a visual swing indicator 400 used in conjunction with a wood-type golf club may have a more outward orientation than a visual swing indicator 400 on an iron type golf club since the golfer's inward initial backswing tendency may be greater than with the wood-type golf club than with the iron-type golf club and thus a more exaggerated visual swing indicator 400 orientation is appropriate.

Additionally, even in a given orientation and size, the visual swing indicator 400 may be formed to possess preferred visual characteristics, shapes, and attributes that optimize golfer comfort, feel, and performance. Since golfers, like many other athletes, enjoy their craft, the particular appearance of the visual swing indicator 400 may contain some expression while serving as a device for assisting the golfer's swing. As demonstrated in FIGS. 7A-7D, numerous configurations of a visual swing indicator 400 are contemplated consistent with the aspects described.

Figure 7A:
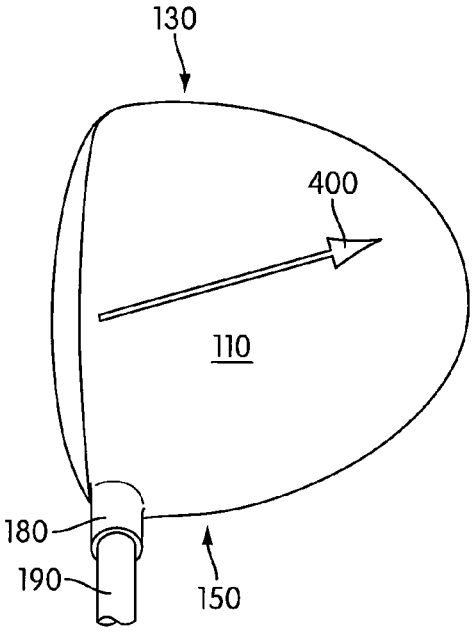
FIGS. 7A-7D are illustrative top plan views of golf club heads with visual swing indicators.
Figure 7B:
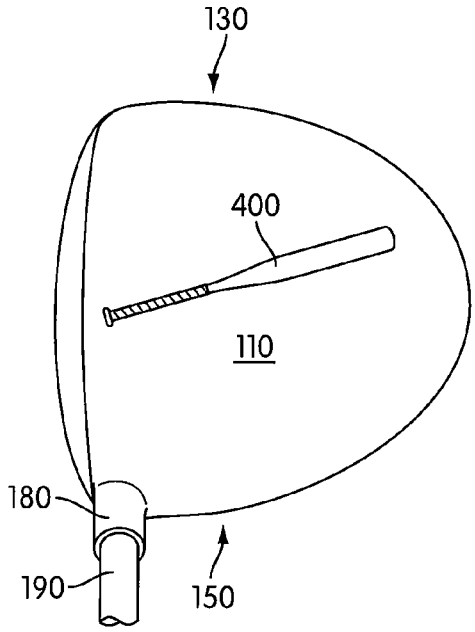
Figure 7C:
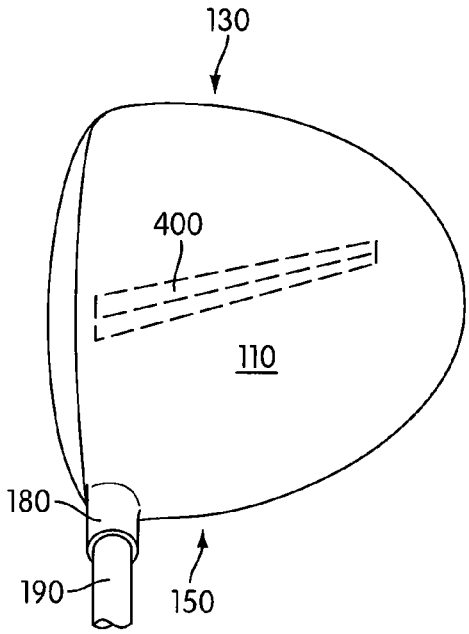
Figure 7D:
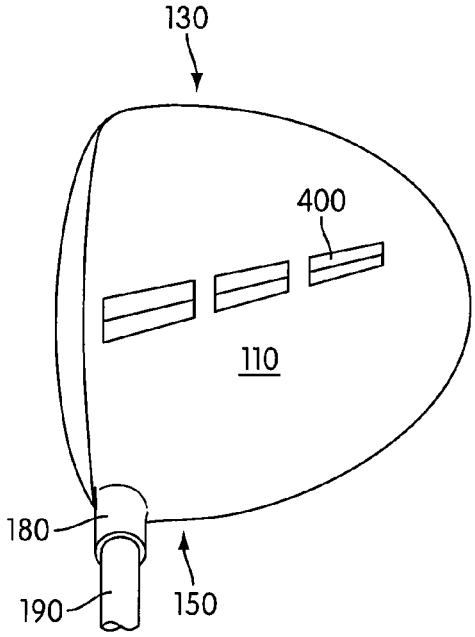

In FIGS. 7A and 7B, visual swing indicator 400 has been formed, shaped and sized to resemble an arrow and a baseball bat respectively. In FIGS. 7C-7D the visual swing indicator 400 has been formed shaped and sized to resemble a strip or a plurality of strips with an interior line in the same direction and thus may serve to further enhance the visual effect and further help the golfer visually perceive the visual swing indicator 400 when the golf club head 100 is both static and moving.

Figure 8A:
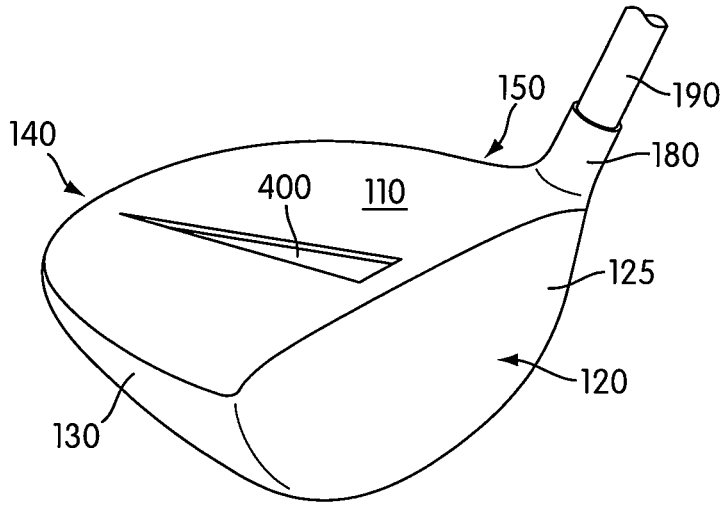
FIGS. 8A-8B are illustrative perspective view diagrams of golf club heads with visual swing indicators.

Also, many manners of incorporating the visual swing indicator 400 into the golf club head 100 are contemplated. In one configuration a golf club head may be formed during the manufacturing process to include the visual swing indicator 400 as a portion of the top surface of the golf club head 100. In such a configuration, the visual swing indicator 400 may be formed as part of a golf club head 100 as a unibody member. Accordingly, a molding or casting or related manufacturing processes that may be used to form the golf club head may account for the visual swing indicator 400 such that a mold is formed to include the visual swing indicator 400 feature as desired. Also, the visual swing indicator 400 may be a protruding structure or extending upward off the top surface such that a generally smooth top surface 110 is interrupted by a visual swing indicator 400 extending upward beyond the general plane of the top surface 110. Alternatively, the visual swing indicator 400 may be formed such that the entire visual swing indicator 400 is formed as a recess in the top surface 110 of the golf club head 100 as is illustratively depicted in FIG. 8A. A recessed visual swing indicator 400 may exhibit some preferred characteristics as the visible impression created by the visual swing indicator 400 may be more apparent visually to the golfer 10 during the addressing state as well as during the initial movement of the golf club head 100 during an initial take-away because the three dimensional aspects may provide further enhance visibility qualities. Further visual enhancements may be used such as contrasting or coloring of the visual swing indicator 400 or contrasting or coloring the sides of the recessed visual swing indicator 400 to further make the visual swing indicator 400 apparent to golfer 10 during a swing of the golf club 199.

Figure 8B:
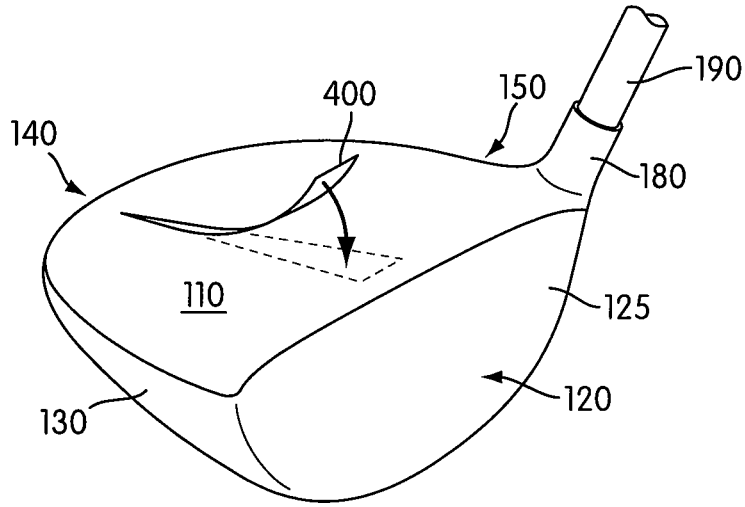

In further configurations, the visual swing indicator 400 may be applied to a top surface 110 of the golf club head 100 after the golf club head 100 has been cast, molded or otherwise formed as is known in the art. Generally speaking, a visual swing indicator 400 may be attached to a top surface 110 of the golf club head 100 as a coating (including paint), a film, an adhesive, an appliqué or various other forms of application. After the golf club is formed of a material, often a metal, the surfaces of the golf club head 100 are treated and coated to improve the durability of the metal and golf club 199 and/or make the golf club head 100 more appealing. Accordingly, a visual swing indicator 400 may also be applied in a similar manner during these painting, coating and related treatment processes during manufacturing of the golf club head 100. A visual swing indicator 400 may also be applied to existing golf club heads 100 in a similar fashion as a further coating, film, paint or the like. Newly manufactured clubs and previously manufactured or after market clubs may be fitted for a visual swing indicator 400 and can be painted on, applied as an adhesive tape, or through an appliqué as desired. FIG. 8 illustratively demonstrates a visual swing indicator 400 in the configuration of an adhesive tape or appliqué being placed on a top surface 110 of a golf club head 100.

Golf professionals are known to work with golfers to assist them in improving their golf game including their swing and associated play by analyzing the golfer's tendencies, providing instruction and recommendation regarding modifications to their swing and also in recommending various equipment including selection of clubs. Further, a golf professional for a certain golf manufacturer may offer a selection of features for which the golfer may select either alone, or with the assistance of the golf professional. Among the features that vary from golf club head to golf club head may be particular visual swing indicator 400 housed on the top surface 110. Each golfer may have a swing tendency that is varied from other golfers. Therefore, a series of visual swing indicators 400 may be available for attachment and use depending on the particular golfer's tendencies needs and desires.

The particulars of the golf club head 100 may be varied in any of a number of varied configurations utilizing an attachment means for attaching the visual swing indicator 400 to the remainder of the golf club head. The visual swing indicator 400 may be snapped onto a top surface, slid and locked into place or applied as an appliqué, paint or the like. For example, the visual swing indicator 400 and the top surface may have complimentary male and female components to form a connection as is know in the art. Snaps, slider mechanism, track and followers and numerous other mechanisms are known. The visual swing indicator 400 may be housed on a member configured with a complimentary structure for attachment to a structure housed on a top surface 110 of the golf club head 100. In other configurations, the attachment mechanism may include a top surface 110 may be removed and replaced with a different top surface including either a top surface 110 with a visual swing indicator 400 or another "distinct" visual swing indicator 400 depending upon whether the golf club head 100 originally included a top surface 110 without a visual swing indicator 400 or with a visual swing indicator 400. Varied top surfaces 110 may be snapped into place or be attached using an adhesive such as glue or other known securing substances. As such, various mechanisms consistent with the principles described above and further herein are contemplated for use with varied configurations of top surfaces and visual swing indicator 400 and associated alternate means.

Figure 9:
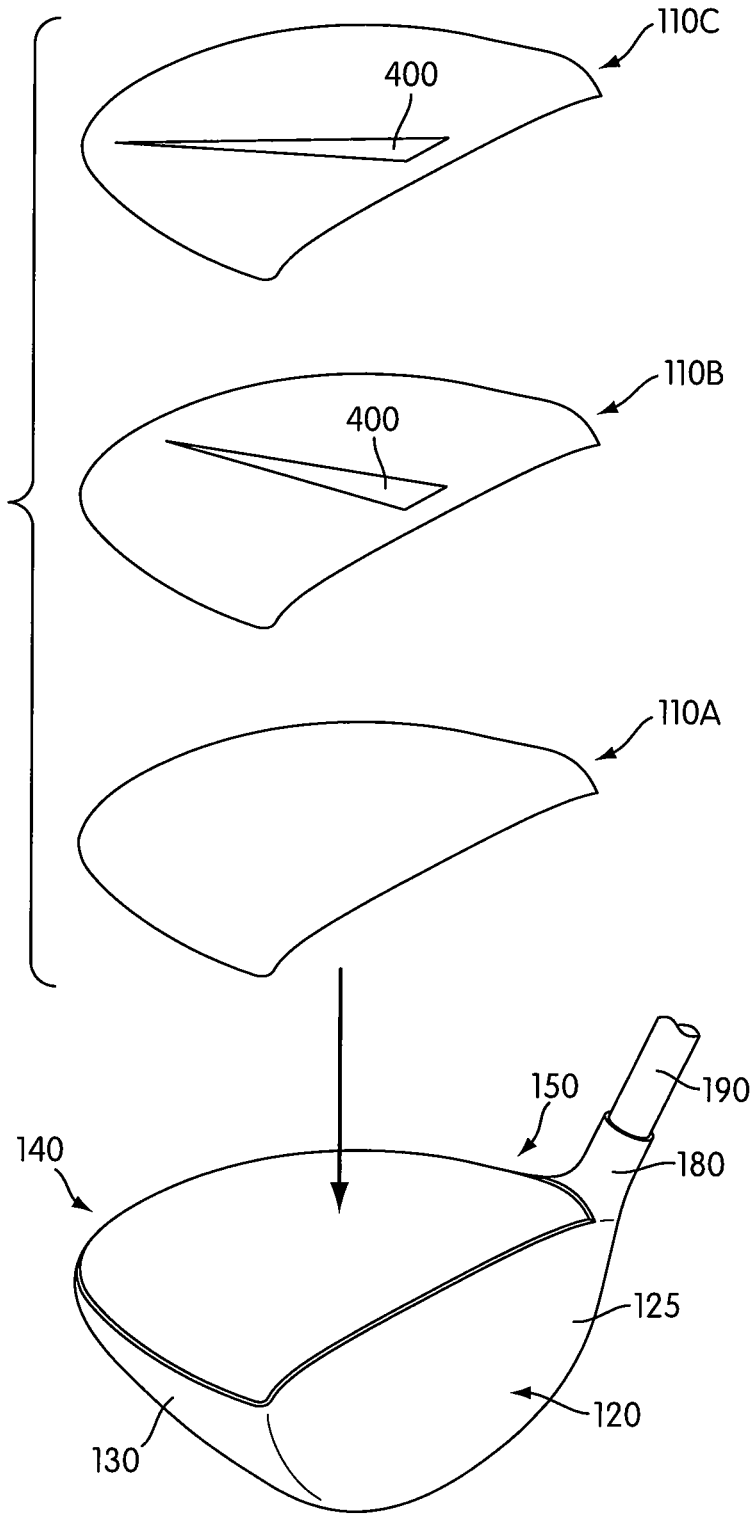
FIG. 9 is an illustrative exploded perspective view diagram of golf club head variable with a number of different visual swing indicators.

FIG. 9 is an exploded view illustrative depicting a schematic diagram of a golf club head 100 with are removable top surface 110. A top surface of a golf club head 100, especially including a wood-type golf club head, may also be referred to as a "crown" of the golf club head 100. Here, FIG. 9 illustrates three top surfaces 110A, 110B, and 110C that may used with the golf club head 100 in an interchangeable fashion. Top surface 110A is a conventional top surface without a visual swing indicator 400. The golf club head may come with a top surface 110A as a standard top surface. Top surfaces 110B and 110C are top surfaces including visual swing indicators 400. The visual swing indicators 400B and 400C may vary by shape, size, and/or orientation. Accordingly, a particular golfer may choose between a variety of top surfaces 110B, 110C of a golf club head and select one of the top surfaces 110B, 110C. In one configuration, a golf fitting professional may provide a cart or display housing various top surfaces that either a golfer may select or the golf fitting professional may recommend based upon the tendencies of the golfer as measured during analysis of the golfer's swing.

Additionally, in a fitting process, a golfer may have his swing analyzed by a professional either visually or by using any of various measuring and analysis devices as are known in the art and will be described further below. Based upon these measurements and analysis of the golfer's swing and swing path as a compared to an actual desired swing path, a given top surface 110B or 110C may be chosen for facilitating an improved golf swing as described previously. Accordingly, a series of top surface 110A, 110B, 110C can be made available such that a variety of golfers having different characteristics, preferences and specific swing paths may use different tops surfaces with visual swing indicators 400 from the series. While FIG. 9 illustrates a series of top surfaces 110 including three distinct club top surface, it is contemplated that a series could include a larger number (e.g. 6, 10, 18 etc) of top surfaces housing varied visual swing indicators 400 so as to provide the desired level of personalization for fitting a golfer with a golf club head 100 with a visual swing indicator 400 for assisting the golfer in overcoming a given tendency.

While a golfer may be fit with a golf club head with one of a series of top surface 110A-110C at a golf shop, securing of the chosen top surface 110A-110C may need to be performed at a manufacturing location in order for a top surface 110 to be integrally formed (e.g. cast). Alternatively, in order for a sophisticated adhesive process and/or material be applied to sufficiently hold the top surface 110 selected on the remainder of the golf club head 100 as the golf club head 100 is used during various swinging and related movements, where the manufacturing of the golf club head 100 may be performed. Additionally, a golfer may use a demonstration or exemplary golf club to select a preferred golf club head from a series and then the golfer may select which version of a golf club head 100 the golfer desires. The top surface may each be one in a series of top surfaces having visual swing indicators 400 that vary in orientation by incremental variances for selection by the golfer (perhaps with assistance). Once a particular top surface 110 (and associated visual swing indicator 400) is chosen, an order may be placed for this particular model of golf club head and a golf manufacturer or other company at the manufacturers direction will produce a copy of that golf club 199 including a golf club head 100 having a visual swing indicator 400 in the orientation and particulars as selected by the golfer/customer.

FIGS. 10A-10C, 11A-11C, 12A-12C and 13A-13C represent still additional configurations of visual swing indicators according to aspects described herein, wherein the visual swing indicators are integrally formed with the golf club head and at least partially define the shape of the perimeter of the golf club head. Similar reference numerals may be used to describe similar structures in relation to FIGS. 1-9.

Figure 10A:
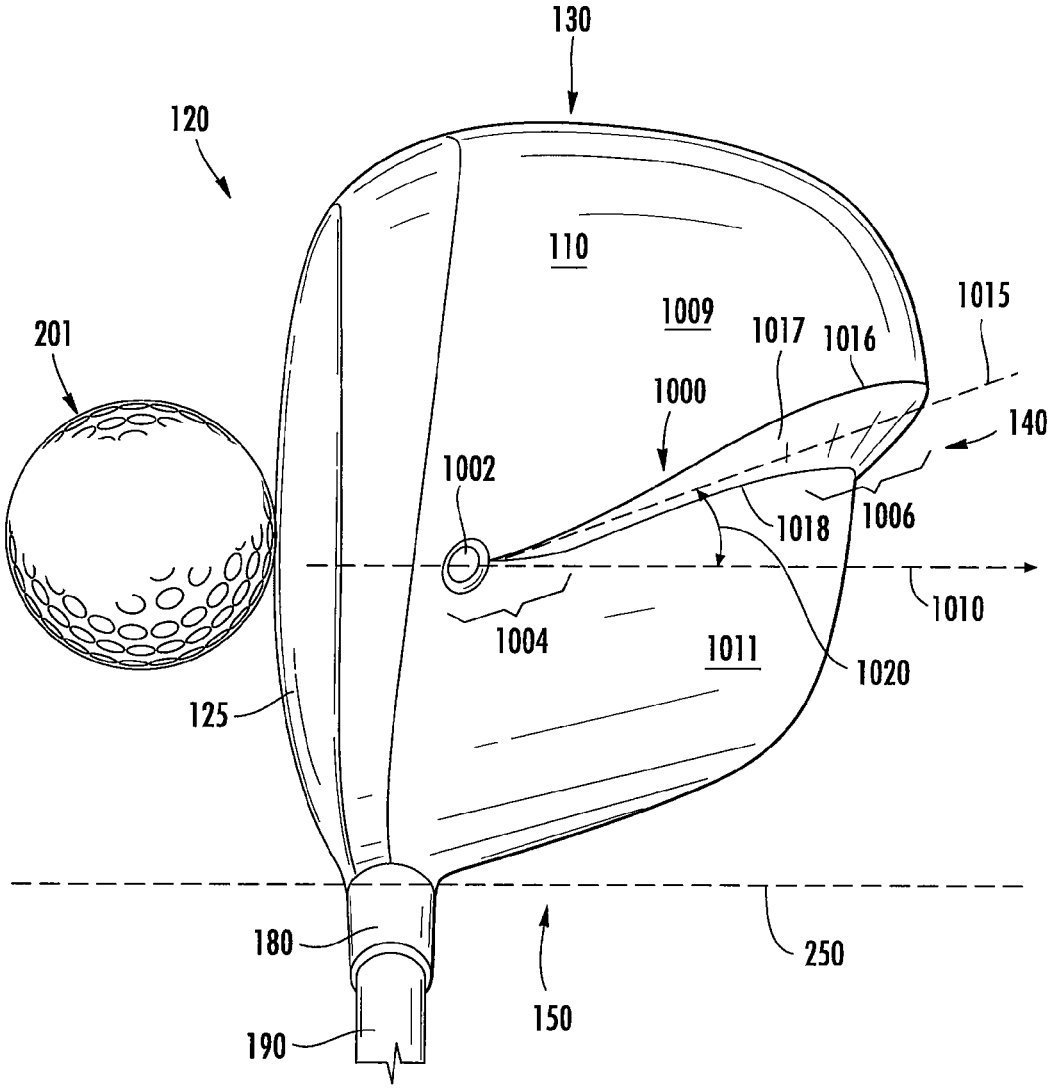
FIGS. 10A-10C are illustrative top plan, perspective and rear views of a golf club head with a visual swing indicator according to further aspects described herein.
Figure 10B:
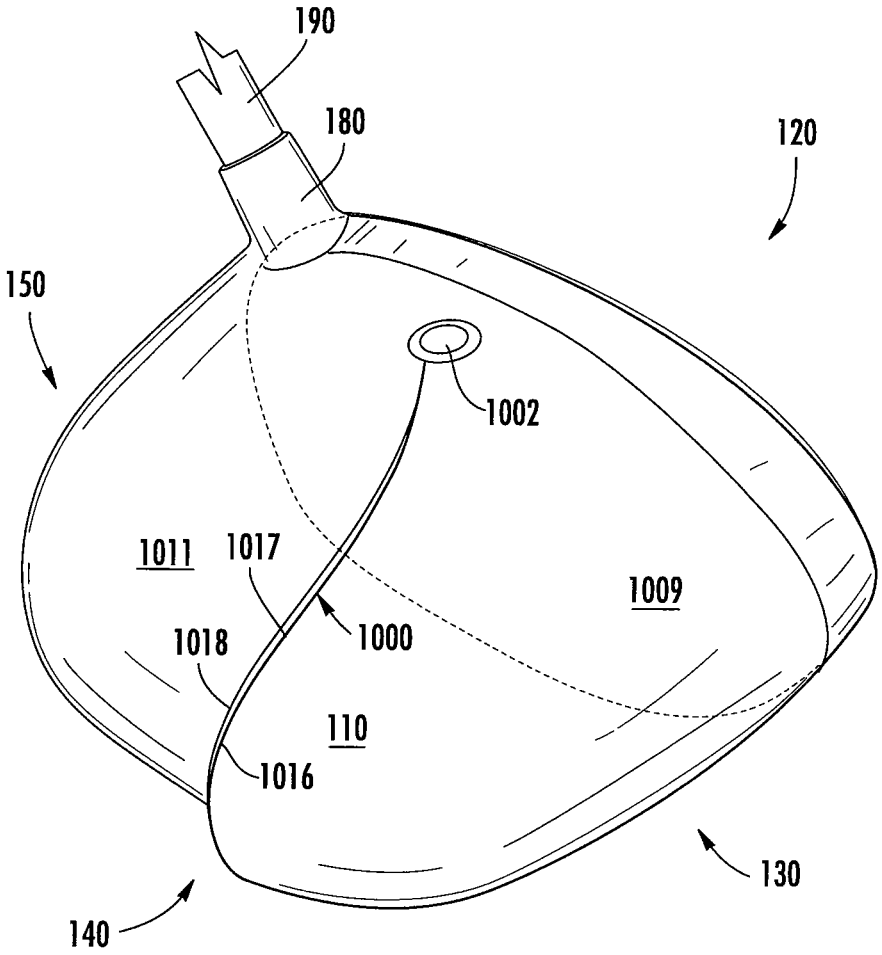
Figure 10C:
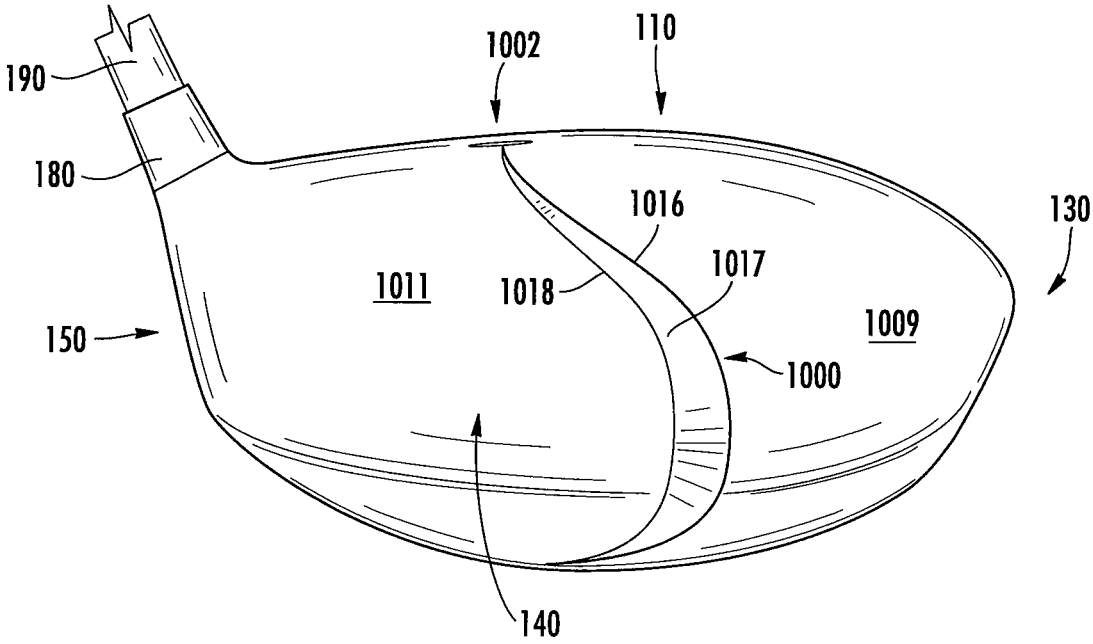

FIGS. 10A-10C depict a top view, a perspective view, and a rear view, respectively, of an exemplary visual swing indicator 1000 that may be formed as part of the exterior surface of the golf club head. As shown in FIGS. 10A-10C, the visual swing indicator 1000 is positioned generally on a top surface 110 of the exemplary golf club head 100. In an exemplary embodiment, the visual swing indicator 1000 is integral with the golf club head 100.

As further shown in FIGS. 10A-10C, integral therewith in an exemplary embodiment, the top surface 110 of the golf club head 100 has an interface area positioned generally between a first portion 1009 of the top surface 110 and a second portion 1011 of the top surface 110. The first portion 1009 generally corresponds to a toe end portion of the top surface 110 of the golf club head and the second portion 1011 generally corresponds to a heel end portion of the top surface 110 of the golf club head. The interface area forms the visual swing indicator 1000. The interface area further comprises an angled surface 1017 (angled from a vertical axis through the golf club head 100) visible on the top surface 110. The angled surface 1017 extends from a first edge 1016 on the top surface 110 to a second edge 1018 on the top surface 110. As further visible in at least FIGS. 10A and 10C, the first edge 1016 is at a higher elevation with respect to the second edge 1018. In addition, the first edge 1016 is more proximate the toe end portion 1009 and the second edge 1018 is more proximate to the heel end portion 1011. In such configuration, the angled surface 1017 angles upwardly from the heel end portion 1011 towards the toe end portion 1009. The specific exemplary visual swing indicator 1000 depicted in FIGS. 10A-10C may further include a central marking 1002, and may have a first end 1004 proximate the ball hitting surface 125 and a second end 1006 located at or near the rear 140 of the golf club head. Central marking 1002 may be positioned so as to identify an ideal ball striking location along the ball hitting surface 125, generally midway between the toe end of the ball hitting surface 125 and the heel end of the ball hitting surface 125. As in FIG. 10A, the end to end width of the visual indicator 1000 may be tapered from the rear 140 to the ball hitting surface 125 (i.e., wider at a second end 1006 and narrower at a first end 1004 such that the shape of visual indicator 1000 as seen from the top view in FIG. 10A is generally triangular). Thus, the first edge 1016 and the second edge 1018 may converge and generally meet at the central marking 1002. As can be appreciated from FIG. 10A, when a golfer views the golf club head 100 when addressing a golf ball 201, the visual swing indicator 1000 provides a portion of the top surface of the golf club head 100 that is visually perceptively different from the remaining portions of the top surface of the golf club head 100. Accordingly, the visual indicator 1000 is visually perceptively different from the first portion 1009 and the second portion 1011.

Referring to FIG. 10A, the visual swing indicator 1000 may be oriented as described herein, such that the path 1015 of the swing indicator 1000 is outward (runs rearward at an angle towards the toe 130 and towards the rear 140) of a swing path 1010, such that an angle 1020 may be formed between the path 1010 and the path 1015. In such a configuration, the visual swing indicator 1000 may be described as pointing from proximate a front of the golf club head 100 rearward toward an area generally between the rear 140 and the toe 130 of the golf club head 100. As described above, the outward positioning of the visual swing indicator 1000 encourages a golfer having certain swing tendencies to follow a take away path along the path 1015 that is generally outwards towards the area between the rear 140 and the toe 130 of the golf club head 100. A golfer 10 in an addressing state looking downward at the top surface 110 of the golf club head 100 will view the visual swing indicator 1000 as a reminder and a pointer as to the direction that the golfer 10 should begin the take-away, or backswing, of the golf club head 100 from the addressing state. Thus, when the golfer 10 begins the take-away of the golf club head 100, the golfer 10 will bring the golf club head 100 back along the trajectory of the indicator 1000, e.g., along the path 1015. By following the path 1015 during the take away, or backswing, it has been determined that the golfer 10 can more easily drop the golf club head 100 back to a more inside swing path in the downswing wherein the golf club head 100 will be positioned such that the ball striking surface 125 will be generally in a square orientation to the path 1010 as shown in FIG. 10A and to provide for an optimum ball-striking configuration. Accordingly, by following the indicated path of the visual swing indicator 1000, which acts as reminder and guide as to which direction to take-away the golf club head 100 from the initial addressing state, a golfer can more easily position the golf club head to an inside path for the downswing of the golf club head 100. There is an increased likelihood the golfer 10 will be able to return the golf club head 100 in a proper path through the hitting region and contact the golf ball 201 in a proper and preferred fashion including an ending downswing path such as a path corresponding to path 320B as described above with reference to FIG. 3B rather than an undesirable ending downswing path as previously described. Thus, the indicator 1000 is a visual reminder for the golfer to follow the inside path in the downswing of the golf club head 100.

As discussed, the visual swing indicator 1000 may be formed as an integral part of golf club head top surface 110. In the specific example depicted in FIGS. 10A-10C, the visual indicator 1000 forms a surface of the perimeter of club head 100 that is at least partially transverse to surface 1009 and surface 1011. It is further understood that the visual swing indicator 1000 can take other forms such as interruptions in the top surface or other surface variations such that the indicator is visually perceptively different from remaining portions of the top surface of the golf club head 100.

Figure 11A:
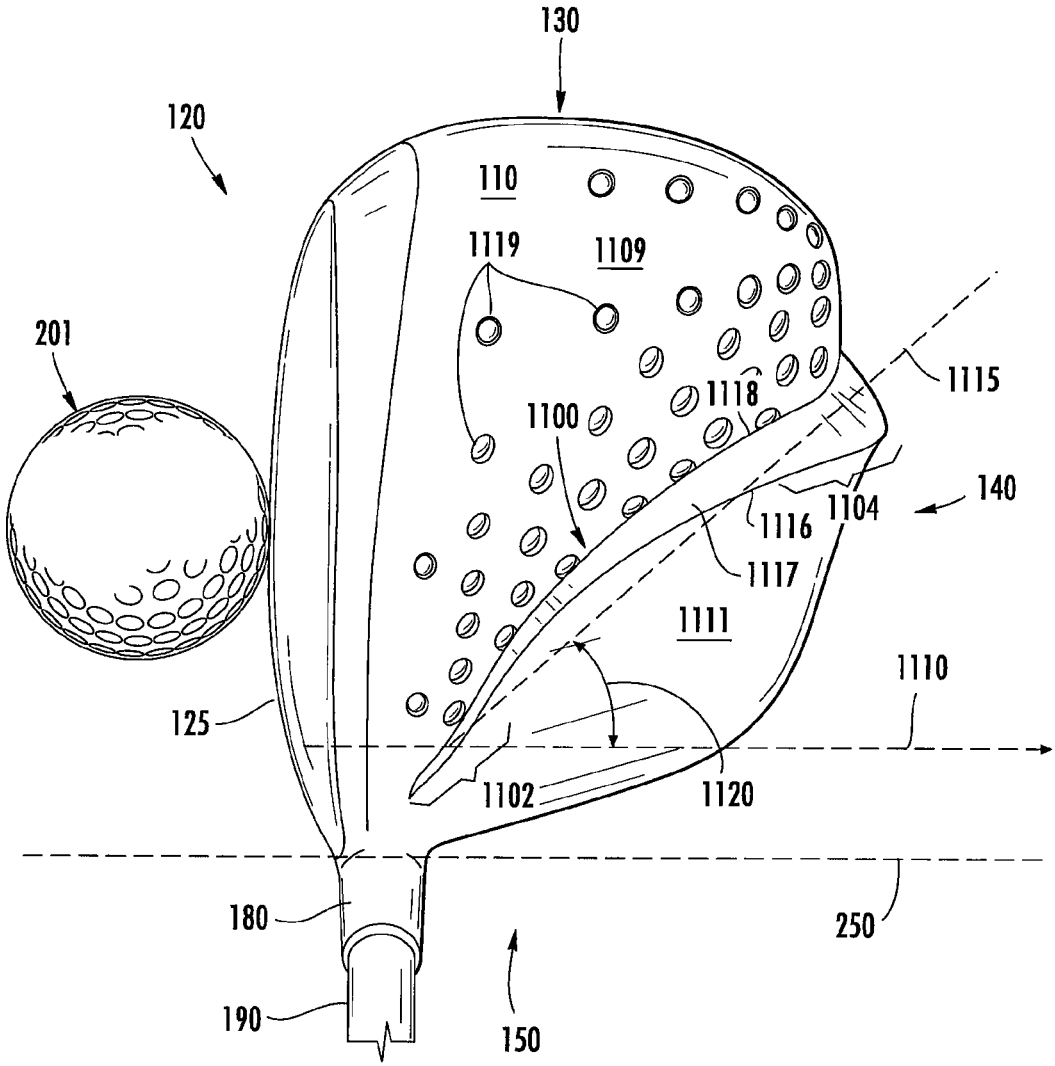
FIGS. 11A-11C are illustrative top plan, perspective and rear views of a golf club head with a visual swing indicator according to still further aspects described herein.
Figure 11B:
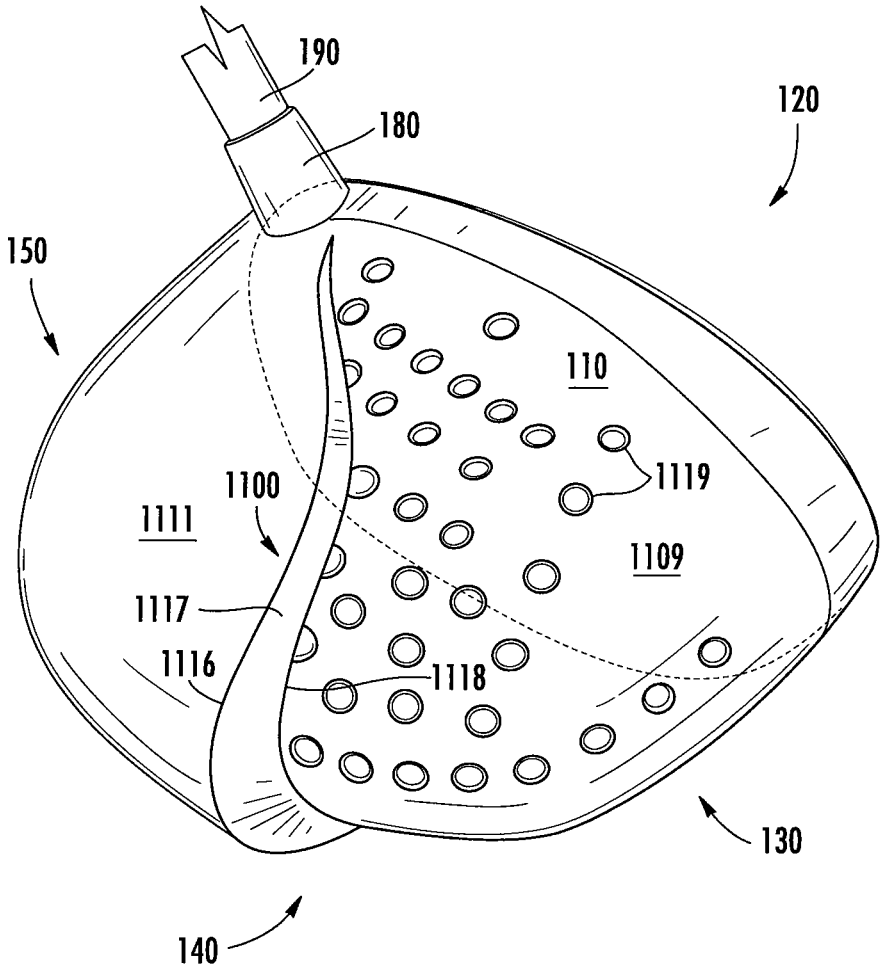
Figure 11C:
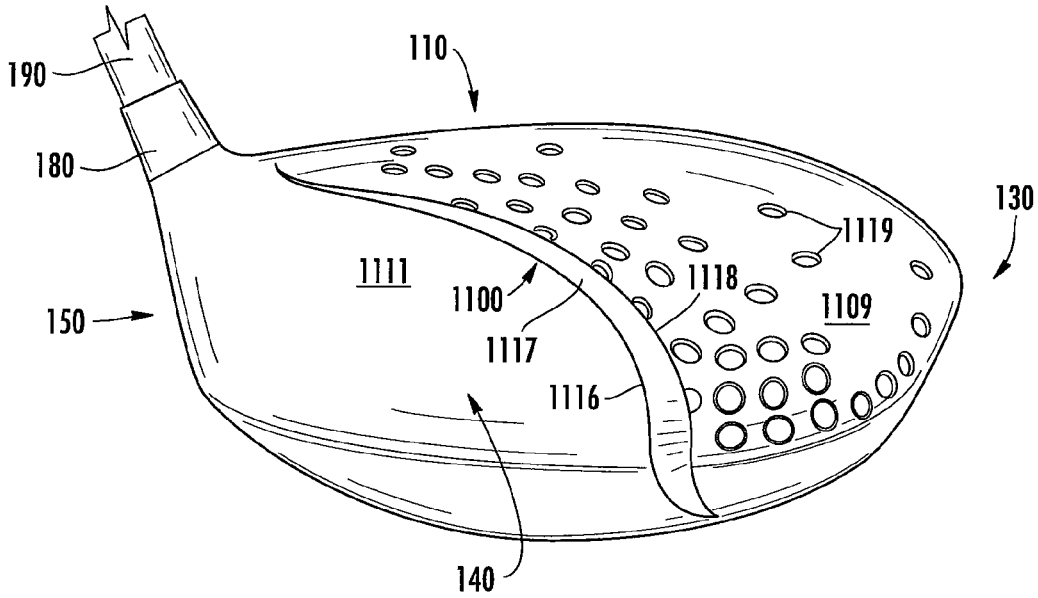

FIGS. 11A-11C depict a top view, a perspective view, and a rear view, respectively, of yet another exemplary visual swing indicator 1100 that may be formed as part of the exterior surface of the golf club head. As shown in FIGS. 11A-11C, the visual swing indicator 1100 is positioned generally on a top surface 110 of exemplary golf club head 100. In an exemplary embodiment, the visual swing indicator 1100 is integral with the golf club head 100.

As further shown in FIGS. 11A-11C, integral therewith in an exemplary embodiment, the top surface 110 of the golf club head 100 has an interface area positioned generally between a first portion 1109 of the top surface 110 and a second portion 1111 of the top surface 110. The first portion 1109 generally corresponds to a toe end portion of the top surface 110 of the golf club head and the second portion 1111 generally corresponds to a heel end portion of the top surface 110 of the golf club head. The interface area forms the visual swing indicator 1100. The interface area further comprises an angled surface 1117 (angled from a vertical axis through the golf club head 100) visible on the top surface 110. The angled surface 1117 extends from a first edge 1116 on the top surface 110 to a second edge 1118 on the top surface 110. As further visible in at least FIGS. 11A-11C, the first edge 1116 is at a higher elevation with respect to the second edge 1118. In addition, the first edge 1116 is more proximate the heel end portion 1111 and the second edge 1118 is more proximate to the toe end portion 1109. In such configuration, the angled surface 1117 angles upwardly from the toe end portion 1109 towards the heel end portion 1111. The specific exemplary visual swing indicator 1100 depicted in FIGS. 11A-11C may further include dimples 1119 on the toe end portion 1109 of the top surface 110 of the golf club head. Dimples 1119 may be positioned to accentuate and/or draw attention to visual indicator 1100. In addition, dimples 1119 may provide a drag-reducing effect to create maximum club head speed during the downswing and moment of impact of the club head 100. In particular dimples 1119 serve to promote turbulent airstreams over the top surface of club head 100, minimizing the air separation region of the club head 100, and thus minimizing the pressure drag of the club head 100. As in FIG. 11A, the end to end width of the visual indicator 1100 may be tapered from the rear surface 140 to the ball hitting surface 125 (i.e., wider at a second end 1104 and narrower at a first end 1102 such that the shape of visual indicator 1100 as seen from the top view in FIG. 11A is generally triangular). Thus, the first edge 1116 and the second edge 1118 may converge and generally meet at a first end 1102. According to one example depicted in FIGS. 11A-11C, the first end 1102 of visual indicator 1100 may be located proximate the heel end portion 1111 of top surface 110 proximate the ball striking surface 120, i.e. near the hosel 180, and the second end 1104 may be located towards the toe end portion 1109 of top surface 110 proximate the rear surface 140. Because the heel 150 of golf club head 100 towards the hosel area 180 is leading the swing during a significant portion of a golfer's downswing, the location of the indicator 1100 helps to direct the airflow along the drag-reducing dimpled portion of the top surface 1109 during that portion of the downswing, thus minimizing drag of the golf club head 100 and increasing its speed. The location of visual indicator 1100 as depicted in FIGS. 11A-11C, however, is only one example of a possible location of the indicator 1100 in accordance with aspects described herein. Those skilled in the art will recognize that the location of visual indicator 1100 (including one or both ends 1102 or 1104) may be shifted towards the toe end portion 1109 of the top surface 110 of the golf club head while still falling within the spirit and scope of the invention. As can be appreciated from FIG. 11A, when a golfer views the golf club head 100 when addressing a golf ball 201, the visual swing indicator 1100 provides a portion of the top surface of the golf club head 100 that is visually perceptively different from the remaining portions of the top surface of the golf club head 100. Accordingly, the visual indicator 1100 is visually perceptively different from the first portion 1109 and the second portion 1111.

The visual swing indicator 1100 may be oriented as described herein, such that the path 1115 of the swing indicator 1100 is outward (runs rearward at an angle towards the toe 130 and towards the rear 140) of a swing path 1115, such that an angle 1120 is formed between a path 1110 and the path 1115. In such a configuration, the visual swing indicator 1100 may be described as pointing from proximate a front of the golf club head 100 rearward toward an area generally between the rear 140 and the toe 130 of the golf club head 100. As described above, the outward positioning of the visual swing indicator 1100 encourages a golfer having certain swing tendencies to follow a take away path along the path 1115 that is generally outward towards the area between the rear 140 and the toe 130 of the golf club head 100. A golfer 10 in an addressing state looking downward at the top surface 110 of the golf club head 100 will view the visual swing indicator 1100 as a reminder and a pointer as to the direction that the golfer 10 should begin the take-away, or backswing, of the golf club head 100 from the addressing state. Thus, when the golfer 10 begins the take-away of the golf club head 100, the golfer 10 will bring the golf club head 100 back along the trajectory of the indicator 1100, e.g., along the path 1115. By following the path 1115 during the take away, or backswing, it has been determined that the golfer 10 can more easily drop the golf club head 100 back to a more inside swing path in the downswing wherein the golf club head 100 will be positioned such that the ball striking surface 125 will be generally in a square orientation to the path 1110 as shown in FIG. 11A and to provide for an optimum ball-striking configuration. Accordingly, by following the indicated path of the visual swing indicator 1100, which acts as a reminder and guide as to which direction to take-away the golf club head 100 from the initial addressing state, a golfer can more easily position the golf club head to an inside path for the downswing of the golf club head 100. There is an increased likelihood the golfer 10 will be able to return the golf club head 100 in a proper path through the hitting region and contact the golf ball 201 in a proper and preferred fashion including an ending downswing path such as a path corresponding to path 320B as described above with reference to FIG. 3B rather than an undesirable ending downswing path as previously described. Thus, the indicator 1100 is a visual reminder for the golfer to follow the inside path in the downswing of the golf club head 100.

As previously discussed, visual swing indicator 1100 may be formed as an integral part of golf club head top surface 110. In the specific example depicted in FIGS. 11A-11C, the visual indicator 1100 forms a surface of the perimeter of club head 100 at least partially transverse to surface 1109 and surface 1111. It is further understood that the visual swing indicator 1100 can take other forms such as interruptions in the top surface or other surface variations such that the indicator is visually perceptively different from remaining portions of the top surface of the golf club head 100.

Figure 12A:
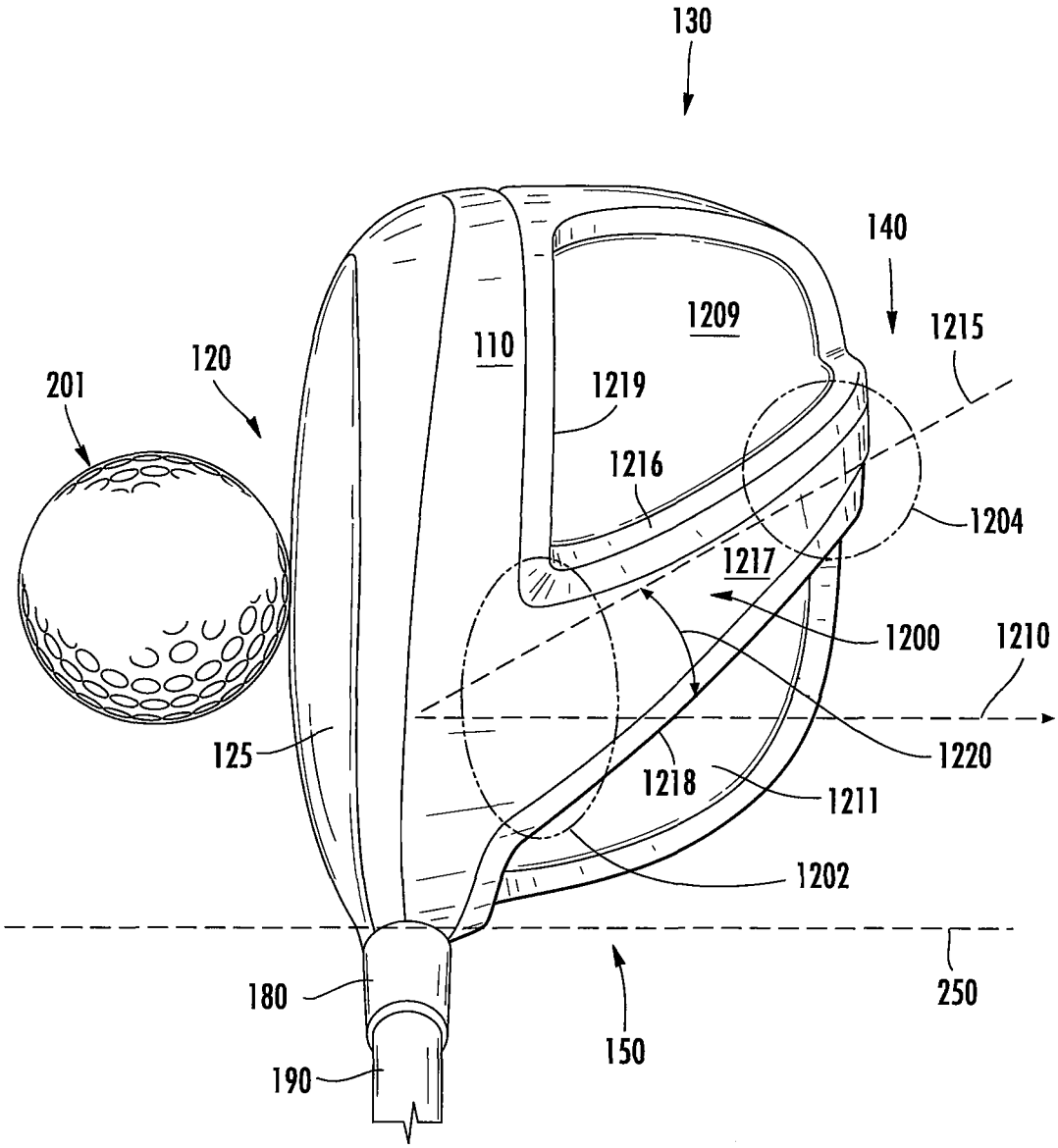
FIGS. 12A-12C are illustrative top plan, perspective and rear views of a golf club head with a visual swing indicator according to still further aspects described herein.
Figure 12B:
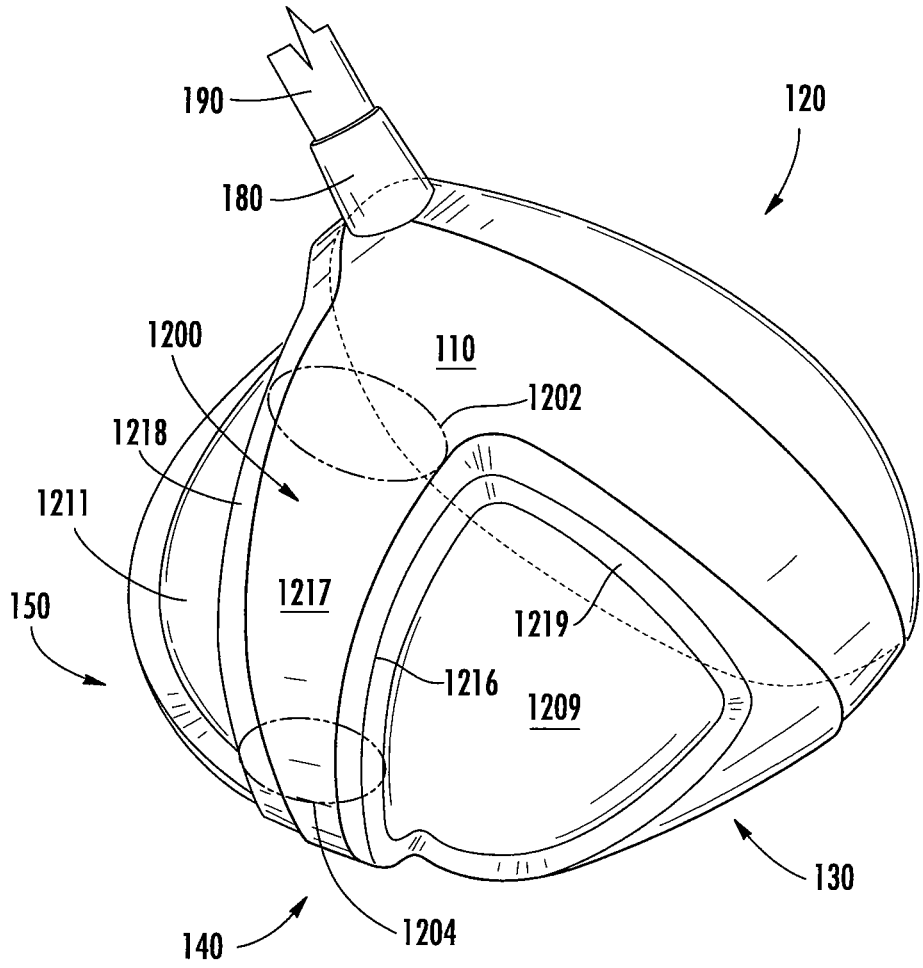
Figure 12C:
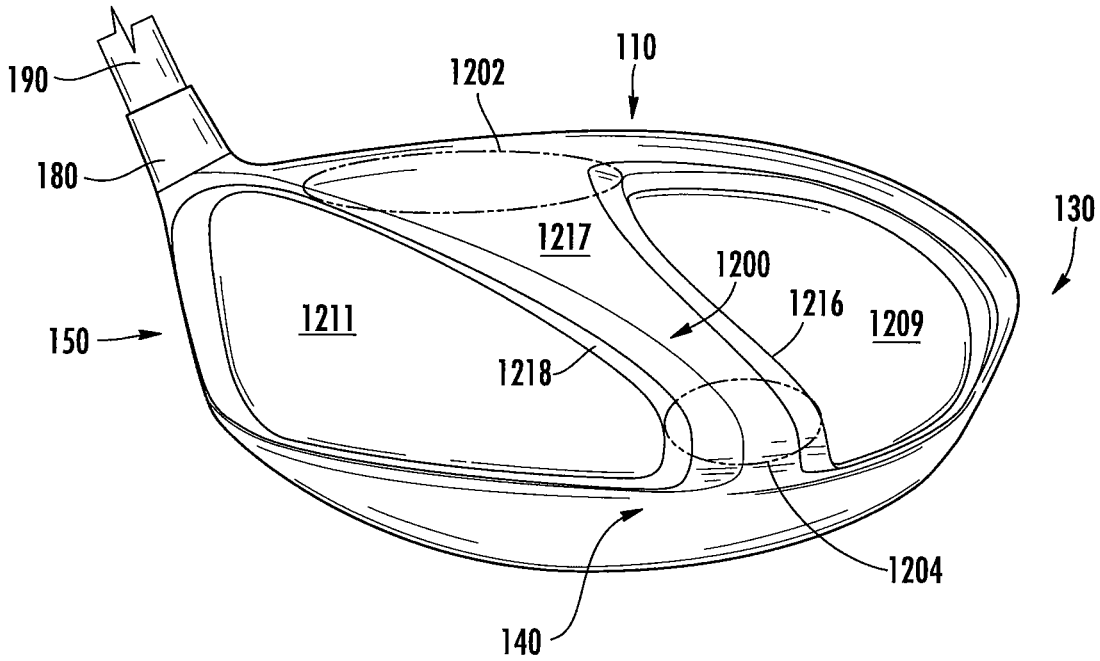

FIGS. 12A-12C depict a top view, a perspective view, and a rear view, respectively, of yet another exemplary visual swing indicator 1200 that may be formed as part of the exterior surface of the golf club head. As shown in FIGS. 12A-12C, the visual swing indicator 1200 is positioned generally on a top surface 110 of exemplary golf club head 100. In an exemplary embodiment, the visual swing indicator 1200 is integral with the golf club head 100

As further shown in FIGS. 12A-12C, integral therewith in an exemplary embodiment, the top surface 110 of the golf club head 100 has an interface area positioned generally between a first portion 1209 of the top surface 110 and a second portion 1211 of the top surface 110. The first portion 1209 generally corresponds to a toe end portion of the top surface 110 of the golf club head and the second portion 1211 generally corresponds to a heel end portion of the top surface 110 of the golf club head. The interface area forms the visual swing indicator 1100. The interface area further comprises a raised portion 1217 of the top surface 110, wherein the interface area is at a higher elevation than the first portion 1209 and the second portion 1211 of the top surface 110 of the golf club head. As such, portions 1209 and 1211 may be considered depressed surfaces with respect to the raised area 1217, such that portions 1209 and 1211 form cavities on the top surface 110 of the golf club head. The depressed first portion 1209 may be further defined by edges 1216, 1219 and the perimeter of the golf club top surface 110 towards the toe end 130 and the rear surface 140. As seen in FIGS. 12A-12C, edges 1216 and 1219 may form corners (i.e., they may be vertical in relation to the mostly horizontal top surface 110 of the golf club head), or they may be rounded so that the top surface 110 of the golf club head is continuous, without cornered areas (example not shown). Furthermore, the depressed second portion 1211 may be further defined by edge 1218 and the perimeter of the golf club top surface 110 towards the heel 150 and the rear 140. Edge 1218 may form a cornered surface (i.e., it may be vertical in relation to the mostly horizontal top surface 110 of the golf club head), or it may be rounded so that the top surface 110 of the golf club head is continuous, without cornered areas (example not shown) The raised surface 1217 extends from first edge 1216 on the top surface 110 to second edge 1218 on the top surface 110. As can be appreciated in FIGS. 12A-12C, the raised interface area 1217 of the top surface 110 creates a visual swing indicator 1200 which is visually and perceptively prominent with respect to the remaining portions 1209 and 1211 of the top surface 110 of the golf club head. As in FIG. 12A, the end to end width of the visual indicator 1200 may be tapered from the rear 140 to the ball hitting surface 125 (i.e., narrower at a second end 1204 and wider at a first end 1202). Such tapering may further accentuate the visual effect of the indicator 1200, however those skilled in the art will recognize that the shape of indicator 1200 may be altered and still fall within the spirit and scope of the invention described herein. According to one example depicted in FIGS. 12A-12C, the first end 1202 of visual indicator 1200 may be located towards the heel end portion 1211 of top surface 110 proximate the ball striking surface 120, i.e. near the hosel 180, and the second end 1204 may be located towards the toe end portion 1209 of top surface 110 proximate the rear 140. The location of visual indicator 1200 as depicted in FIGS. 12A-12C, however, is only one example of a possible location of the indicator 1200 in accordance with aspects described herein. Those skilled in the art will recognize that the location of visual indicator 1200 (including one or both ends 1202 or 1204) may be shifted towards the toe end portion 1209 of the top surface 110 of the golf club head while still falling within the spirit and scope of the invention. As can be appreciated from FIG. 12A, when a golfer views the golf club head 100 when addressing a golf ball 201, the visual swing indicator 1200 provides a portion of the top surface of the golf club head 100 that is visually perceptively different from the remaining portions of the top surface of the golf club head 100. Accordingly, the visual indicator 1200 is visually perceptively different from the first portion 1209 and the second portion 1211.

Visual swing indicator 1200 may be oriented as described herein, such that the path 1215 of the swing indicator 1200 is outward (runs rearward at an angle towards the toe 130 and towards the rear 140) of a swing path 1215, such that an angle 1220 is formed between a path 1210 and the path 1215. In such a configuration, the visual swing indicator 1200 may be described as pointing from proximate a front of the golf club head 100 rearward toward an area generally between the rear 140 and the toe 130 of the golf club head 100. As described above, the outward positioning of the visual swing indicator 1200 encourages a golfer having certain swing tendencies to follow a take away path along the path 1215 that is generally outward towards the area between the rear 140 and the toe 130 of the golf club head 100. A golfer 10 in an addressing state looking downward at the top surface 110 of the golf club head 100 will view the visual swing indicator 1200 as a reminder and a pointer as to the direction that the golfer 10 should begin the take-away, or backswing, of the golf club head 100 from the addressing state. Thus, when the golfer 10 begins the take-away of the golf club head 100, the golfer 10 will bring the golf club head 100 back along the trajectory of the indicator 1200, e.g., along the path 1215. By following the path 1215 during the take away, or backswing, it has been determined that the golfer 10 can more easily drop the golf club head back to a more inside swing path in the downswing wherein the golf club head 100 will be positioned such that the ball striking surface 125 will be generally in a square orientation to the path 1210 as shown in FIG. 12A and to provide for an optimum ball-striking configuration. Accordingly, by following the indicated path of the visual swing indicator 1200, which acts as a reminder and guide as to which direction to take-away the golf club head 100 from the initial addressing state, a golfer can more easily position the golf club head to an inside path for the downswing of the golf club head 100. There is an increased likelihood the golfer 10 will be able to return the golf club head 100 in a proper path through the hitting region and contact the golf ball 201 in a proper and preferred fashion including an ending downswing path such as a path corresponding to path 320B as described above with reference to FIG. 3B rather than an undesirable ending downswing path as previously described. Thus, the indicator 1200 is a visual reminder for the golfer to follow the inside path in the downswing of the golf club head 100.

As previously indicated, visual swing indicator 1200 may be formed as an integral part of golf club head top surface 110. In the specific example depicted in FIGS. 12A-12C, the visual indicator 1200 forms a surface of the perimeter of club head 100 that is raised, and at a higher elevation, with respect to depressed surfaces 1209 and 1211. It is further understood that the visual swing indicator 1200 can take other forms such as interruptions in the top surface or other surface variations such that the indicator is visually perceptively different from remaining portions of the top surface of the golf club head 100.

Figure 13A:
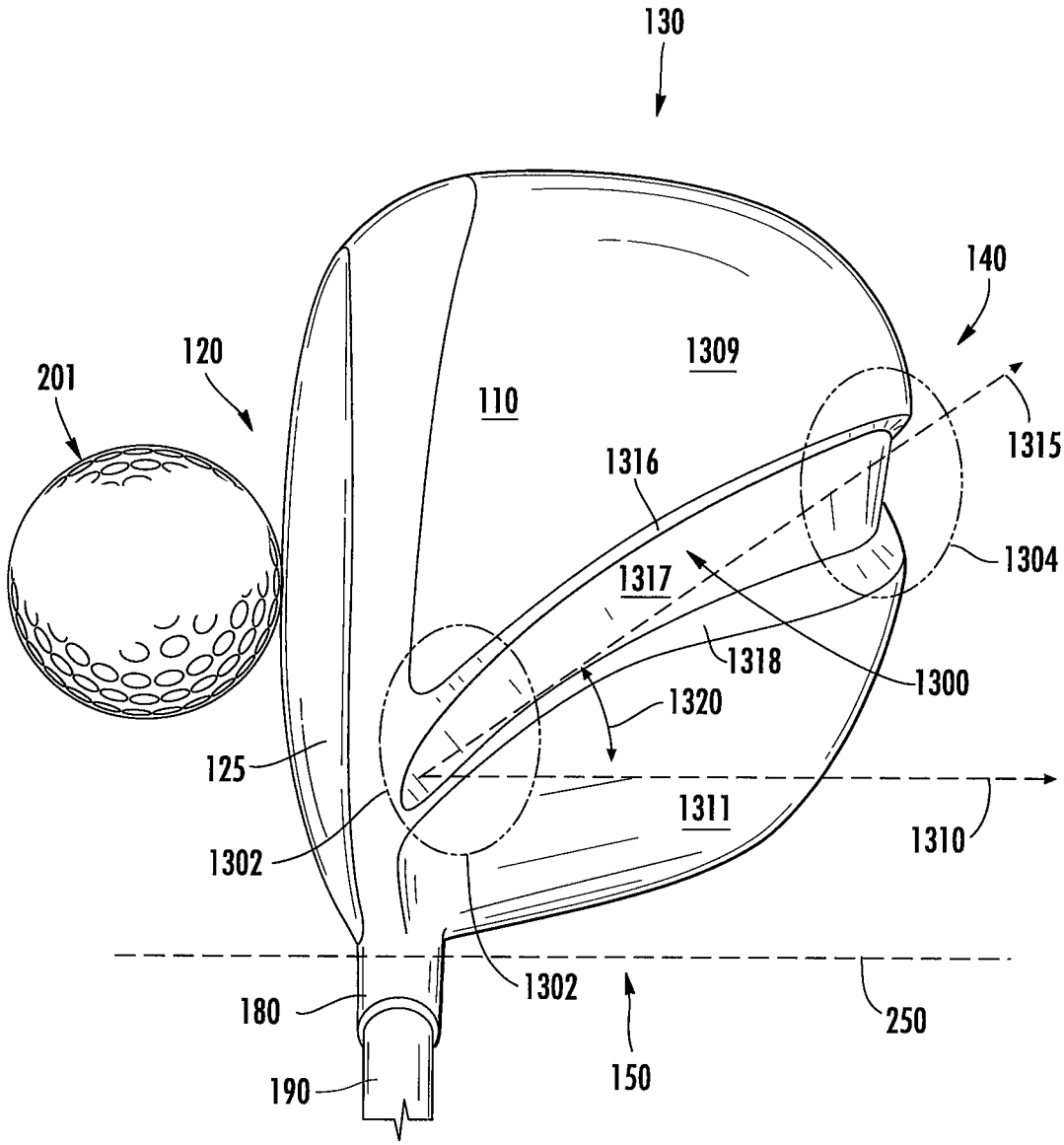
FIGS. 13A-13C are illustrative top plan, perspective and rear views of a golf club head with a visual swing indicator according to still further aspects described herein.
Figure 13B:
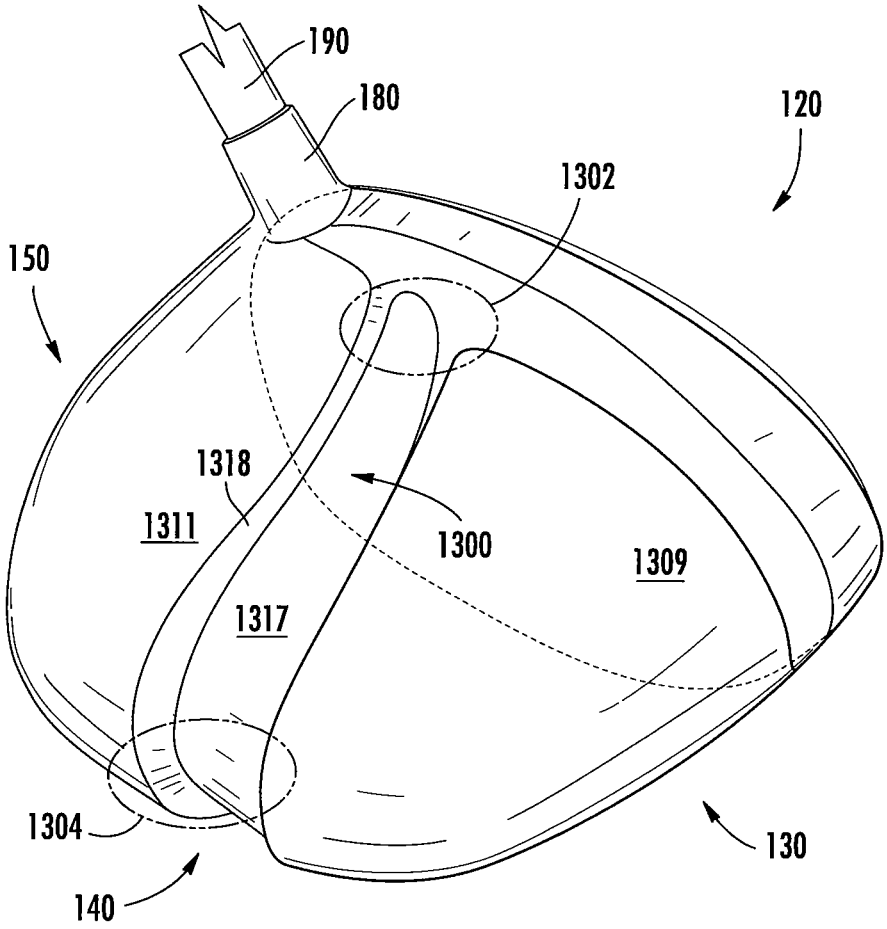
Figure 13C:
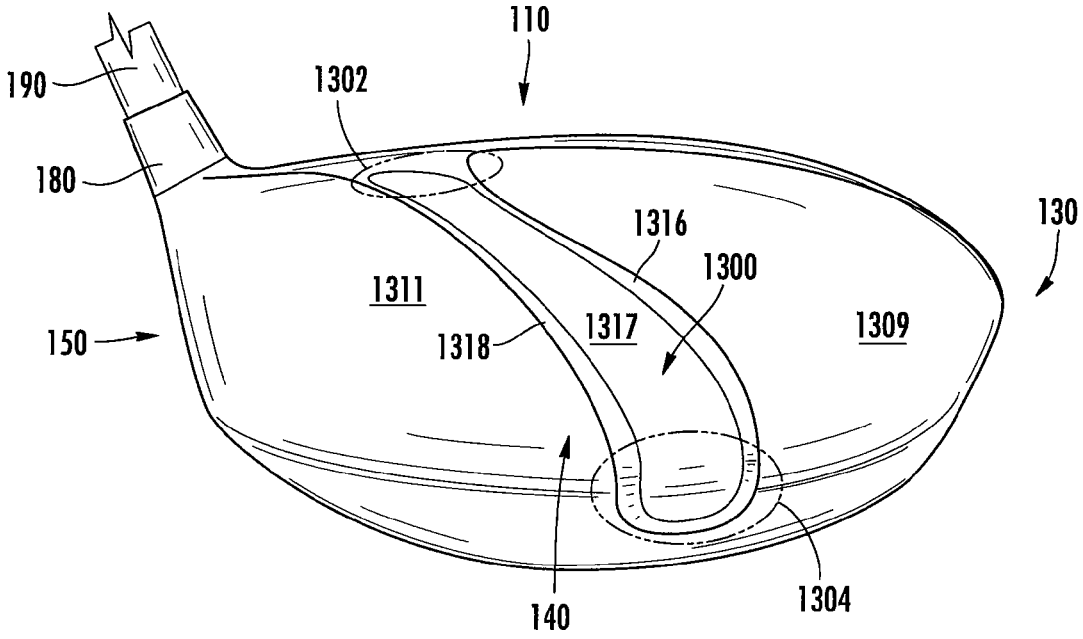

FIGS. 13A-13C depict a top view, a perspective view, and a rear view, respectively, of yet another exemplary visual swing indicator 1300 that may be formed as part of the exterior surface of the golf club head. As shown in FIGS. 13A-13C, the visual swing indicator 1300 is positioned generally on a top surface 110 of exemplary golf club head 100. In an exemplary embodiment, the visual swing indicator 1300 is integral with the golf club head 100.

As further shown in FIGS. 13A-13C, integral therewith in an exemplary embodiment, the top surface 110 of the golf club head 100 has an interface area positioned generally between a first portion 1309 of the top surface 110 and a second portion 1311 of the top surface 110. The first portion 1309 generally corresponds to a toe end portion of the top surface 110 of the golf club head and the second portion 1311 generally corresponds to a heel end portion of the top surface 110 of the golf club head. The interface area forms the visual swing indicator 1300. The interface area further comprises a channel or depressed portion 1317 of the top surface 110, wherein the depressed area 1317 is at a lower elevation than the first portion 1309 and the second portion 1311 of the top surface 110 of the golf club head. As such, portions 1309 and 1311 may be considered raised surfaces with respect to the interface area, such that the depressed area 1317 forms a channeled cavity on the top surface 110 of the golf club head. The depressed area 1317 may be further defined by angled edges 1316 and 1318 (angled from a vertical axis through the golf club head). The depressed area 1317, while creating visual indicator 1300, also creates a more streamlined airflow over the top of the golf club head 100. In the example depicted in FIGS. 13A and 13C, angled edge 1316 angles upwardly toward the toe end portion 1309 and angled edge 1318 angles upwardly toward the heel end portion 1311 to accentuate the depressed area 1317 and visual indicator 1300. While edges 1316 and 1318 are depicted as angled, those skilled in the art will recognize that the edges 1316 and 1318 may also be straight vertical or the corners may be rounded (so that interface area flows as a smooth continuous surface to elevated portions 1309 and 1311, example not shown) and still fall within the scope and spirit of the invention. As can be appreciated in FIGS. 13A-13C, the depressed area 1317 of the top surface 110 creates visual swing indicator 1300 which is visually and perceptively different than the remaining portions 1309 and 1311 of the top surface of the golf club head. As in FIG. 13A, the end to end width of the visual indicator 1300 may be tapered from the rear 140 to the ball hitting surface 125 (i.e., narrower at a first end 1302 and wider at a second end 1304). Such tapering may further accentuate the visual effect of the indicator 1300, however those skilled in the art will recognize that the shape of indicator 1300 may be altered and still fall within the spirit and scope of the invention described herein. According to the example depicted in FIGS. 13A-13C, the first end 1302 of visual indicator 1300 may be located towards the heel end portion 1311 of top surface 110 proximate the ball striking surface 120, i.e. near the hosel 180, and the second end 1304 may be located towards the toe end portion 1309 of top surface 110 proximate the rear surface 140. The location of visual indicator 1300 as depicted in FIGS. 13A-13C, however, is only one example of a possible location of the indicator 1300 in accordance with aspects described herein. Those skilled in the art will recognize that the location of visual indicator 1300 (including one or both ends 1302 or 1304) may be shifted further towards the toe end 130 of the top surface 110 of the golf club head while still falling within the spirit and scope of the invention. As can be appreciated from FIG. 13A, when a golfer views the golf club head 100 when addressing a golf ball 201, the visual swing indicator 1300 provides a portion of the top surface of the golf club head 100 that is visually perceptively different from the remaining portions of the top surface of the golf club head 100. Accordingly, the visual indicator 1300 is visually perceptively different from the first portion 1309 and the second portion 1311.

Visual swing indicator 1300 may be oriented as described herein, such that the path 1315 of the swing indicator 1300 is outward (runs rearward at an angle towards the toe 130 and towards the rear 140) of a swing path 1315, such that an angle 1320 is formed between a path 1310 and the path 1315. In such a configuration, the visual swing indicator 1300 may be described as pointing from proximate a front of the golf club head 100 rearward toward an area generally between the rear 140 and the toe 130 of the golf club head 100. As described above, the outward positioning of the visual swing indicator 1300 encourages a golfer having certain swing tendencies to follow a take away path along the path 1315 that is generally outwards towards the area between the rear 140 and the toe 130 of the golf club head 100. A golfer 10 in an addressing state looking downward at the top surface 110 of the golf club head 100 will view the visual swing indicator 1300 as a reminder and a pointer as to the direction that the golfer 10 should begin the take-away, or backswing, of the golf club head 100 from the addressing state. Thus, when the golfer 10 begins the take-away of the golf club head 100, the golfer 10 will bring the golf club head 100 back along the trajectory of the indicator 1300, e.g., along the path 1315. By following the path 1315 during the take away, or backswing, it has been determined that the golfer 10 can more easily drop the golf club head 100 back to a more inside swing path in the downswing wherein the golf club head 100 will be positioned such that the ball striking surface 125 will be generally in a square orientation to the path 1310 as shown in FIG. 13A and to provide for an optimum ball-striking configuration. Accordingly, by following the indicated path of the visual swing indicator 1300, which acts as a reminder and guide as to which direction to take-away the golf club head 100 from the initial addressing state, a golfer can more easily position the golf club head to an inside path for the downswing of the golf club head 100. There is an increased likelihood the golfer 10 will be able to return the golf club head 100 in a proper path through the hitting region and contact the golf ball 201 in a proper and preferred fashion including an ending downswing path such as a path corresponding to path 320B as described above with reference to FIG. 3B rather than an undesirable ending downswing path as previously described. Thus, the indicator 1300 is a visual reminder for the golfer to follow the inside path in the downswing of the golf club head.

As previously indicated, visual swing indicator 1300 may be formed as an integral part of golf club head top surface 110. In the specific example depicted in FIGS. 13A-13C, the visual indicator 1300 forms a surface of the perimeter of club head 100 that is depressed, and at a lower elevation, with respect to raised surfaces 1309 and 1311. It is further understood that the visual swing indicator 1300 can take other forms such as interruptions in the top surface or other surface variations such that the indicator is visually perceptively different from remaining portions of the top surface of the golf club head 100.

The visual swing indicators depicted in FIGS. 10A-13C may be formed using a variety of methods known to those skilled in the art. For example, the exemplary golf club heads with visual swing indicators depicted in FIGS. 10A-13C may be formed during the manufacturing process to include the respective visual swing indicators as a portion of the top surface 110 of the golf club head 100. For examples, the golf club head may be formed with the exemplary visual swing indicators using molding, casting or other related manufacturing process.

As described above, a visual swing indicator that exhibits three-dimensional characteristics, such as the illustrative visual swing indicators 1000, 1100, 1200 and 1300 depicted in FIGS. 10A-13C may also facilitate visual referencing by golfer 10. For instance, with a three-dimensional visual swing indicator, the visible impression created by the visual swing indicators may be more enhanced to the golfer 10 during the addressing state as well as during the initial movement of the golf club head 100 during an initial take-away. Further visual enhancements may be used such as contrasting or coloring of the visual swing indicators 1000, 1100 1300, or contrasting or coloring the recessed portions of a top surface 110, such as portions 1209 and 1211, for visual swing indicator 1200. Such coloring or contrasting may be applied as a coating, such as paint, a film, an adhesive, an appliqué, or other form of coating known in the art. The contrasting may also be accomplished during the manufacturing process by variation of the material and/or the manufacturing process used for the top surface 110 of the golf club head.

As discussed, it is understood and contemplated that each golfer varies in physical characteristics and swing tendencies. Several visual swing indicator configurations are disclosed herein that can be utilized by golfers in various fashions. It is understood that the structures can be utilized by a golfer having certain swing tendencies to assist in providing a take away path that is generally straight rearward. As described herein, the structures can also be utilized by a golfer having certain swing tendencies to assist in providing a take away path that is generally outward towards the area between the rear and the toe of the golf club head as described herein. Utilizing the indicator in this particular fashion assists the golfer in following the inside path in the downswing of the golf club head 100. Generally, the visual swing indicators assist golfers in optimally orientating the club head to strike the golf ball.

The present invention is disclosed above and in the accompanying drawings with reference to a variety of embodiments. The purpose served by disclosure of the embodiments, however, is to provide an example of the various aspects embodied in the invention, not to limit the scope of the invention. One skilled in the art will recognize that numerous variations and modifications may be made to the embodiments without departing from the scope of the present invention, as defined by the appended claims.

I claim:

1. A golf club head comprising:

a body comprising a mutliplanar top surface, a sole, a toe end, a heel end adjacent to a shaft connecting member, a ball striking face, and a rear surface opposite the ball striking face;

an indicator integral with the top surface and formed on a plane of the top surface that is at least partially transverse to a plane comprising the remainder of the top surface, wherein the indicator is positioned to be visible to a golfer when addressing a golf ball, and wherein the indicator begins at or near the ball striking face and follows a path towards both the toe end and the rear surface opposite the ball striking face.

2. The golf club head of claim 1, wherein the indicator comprises a first end at or near the ball striking face and a second end at or near the rear surface opposite the ball striking face.

3. The golf club head of claim 2, wherein the indicator further comprises a ball striking mark disposed on the top surface at the first end of the indicator, and wherein the ball striking mark indicates an ideal location along the ball striking face for striking a golf ball.

4. The golf club head of claim 2, wherein the second end of the indicator is located closer to the toe end than to the heel end.

5. The golf club head of claim 2, wherein the first end of the indicator is narrower than the second end of the indicator.

6. The golf club head of claim 5, wherein the indicator is generally triangular shaped, and wherein the first end is an apex of a triangle and the second end is a base side of the triangle.

7. The golf club head of claim 2, wherein the first end of the indicator is located on the top surface at or near the shaft connecting member.

8. The golf club head of claim 7, wherein the second end of the indicator is located at or near the rear surface at least partially between the toe end and the heel end.

9. The golf club head of claim 8, wherein the first end of the indicator is narrower than the second end of the indicator.

10. The golf club head of claim 9, wherein the indicator is generally triangular shaped, and wherein the first end is an apex of a triangle and the second end is a base side of the triangle.

11. The golf club head of claim 9, wherein the top surface is multiplanar, and wherein the indicator is formed on a plane of the top surface that is at least partially transverse to a plane comprising the remainder of the top surface.

12. The golf club head of claim 9, wherein the first end of the indicator is wider than the second end of the indicator.

13. The golf club head of claim 12, wherein the indicator is located on a raised portion of the top surface and is adjacent to a depressed portion of the top surface at the toe end and a depressed portion of the top surface at the heel end.

14. The golf club head of claim 9, wherein the indicator is located on a depressed portion of the top surface and is adjacent to a raised portion of the top surface at the toe end and a raised portion of the top surface at the heel end.

15. The golf club of claim 1, wherein a coating is applied to the indicator, and wherein the coating is selected from the following group: paint, an appliqué, a film or an adhesive.

16. A golf club head comprising:

a body comprising a top surface, a sole, a toe end, a heel end adjacent to a shaft connecting member, a ball striking face, and a rear surface opposite the ball striking face;

an indicator integral with the body at the top surface, the indicator visible to a golfer when addressing a golf ball, the indicator being visually perceptively different from remaining portions of the top surface of the body, wherein the indicator begins at or near the ball striking face and follows a path towards both the toe end and the rear surface opposite the ball striking face, wherein the indicator is formed on a plane of the top surface that is at least partially transverse to a plane comprising the remainder of the top surface, wherein the plane of the indicator angles upward from the heel end towards the toe end, and wherein the indicator includes a ball striking mark disposed on the top surface at or near the ball striking face.

17. A golf club head comprising:

a body comprising a top surface, a sole, a toe end, a heel end adjacent to a shaft connecting member, a ball striking face, and a rear surface opposite the ball striking face;

an indicator integral with the body at the top surface, the indicator visible to a golfer when addressing a golf ball, the indicator being visually perceptively different from remaining portions of the top surface of the body, wherein the indicator begins at or near the ball striking face near the shaft connecting member and follows a path towards both the toe end and the rear surface opposite the ball striking face, wherein the indicator is formed on a plane of the top surface that is at least partially transverse to a plane comprising the remainder of the top surface, and wherein the plane of the indicator angles upward from the toe end towards the heel end.

18. A golf club head comprising:

a body comprising a top surface, a sole, a toe end, a heel end adjacent to a shaft connecting member, a ball striking face, and a rear surface opposite the ball striking face;

an indicator integral with the body at the top surface, the indicator visible to a golfer when addressing a golf ball, the indicator being visually perceptively different from remaining portions of the top surface of the body, wherein the indicator begins at or near the ball striking face and follows a path towards both the toe end and the rear surface opposite the ball striking face, and wherein the indicator is located on a portion of the top surface that is defined by an adjacent first depressed portion of the top surface at the heel end and an adjacent second depressed portion of the top surface at the toe end, the first and second depressed portions being positioned on opposed sides of the indicator.

19. A golf club head comprising:

a body comprising a top surface, a sole, a toe end, a heel end adjacent to a shaft connecting member, a ball striking face, and a rear surface opposite the ball striking face;

an indicator integral with the body at the top surface, the indicator visible to a golfer when addressing a golf ball, the indicator being visually perceptively different from remaining portions of the top surface of the body, wherein the indicator begins at or near the ball striking face and follows a path towards the toe end and the rear surface opposite the ball striking face, and wherein the indicator is located on a portion of the top surface that is defined by an adjacent first raised portion of the top surface at the heel end and an adjacent second raised second portion of the top surface at the toe end, the first and second raised portions being positioned on opposed sides of the indicator.

* * * * *

UNITED STATES PATENT AND TRADEMARK OFFICE

CERTIFICATE OF CORRECTION

PATENT NO. : 8,556,742 B2
APPLICATION NO. : 12/900317
DATED : October 15, 2013
INVENTOR(S) : John T. Stites It is certified that error appears in the above-identified patent and that said Letters Patent is hereby corrected as shown below:

Title Page:

In the Inventor name Item (75) please change:

"T. Stites John"

to

-- John T. Stites --.

Signed and Sealed this
Seventeenth Day of December, 2013

Margaret A. Focarino

Margaret A. Focarino
*Commissioner for Patents of the United States Patent and Trademark Office*